US007263862B2

(12) United States Patent
Lyu et al.

(10) Patent No.: US 7,263,862 B2
(45) Date of Patent: Sep. 4, 2007

(54) PENETRATION TYPE WASHING MACHINE, METHOD FOR CONTROLLING THE SAME, AND TUB COVER

(75) Inventors: Jae Cheol Lyu, Kyongsangnam-do (KR); Sung Jin Cho, Kyongsangnam-do (KR); Hyung Dae Ryu, Kyongsangnam-do (KR); Chang Sik Kang, Kyonggi-do (KR); Ji Maeng Kim, Kyongsangnam-do (KR)

(73) Assignee: LG Electronics, Inc., Seoul (KR)

( * ) Notice: Subject to any disclaimer, the term of this patent is extended or adjusted under 35 U.S.C. 154(b) by 184 days.

(21) Appl. No.: 10/724,235

(22) Filed: Dec. 1, 2003

(65) Prior Publication Data

US 2004/0168482 A1 Sep. 2, 2004

Related U.S. Application Data

(60) Continuation of application No. 10/052,246, filed on Jan. 23, 2002, now Pat. No. 6,668,410, which is a division of application No. 09/376,375, filed on Aug. 18, 1999, now Pat. No. 6,351,974.

(30) Foreign Application Priority Data

| | | |
|---|---|---|
| Aug. 18, 1998 | (KR) | 98-033481 |
| Aug. 18, 1998 | (KR) | 98-033482 |
| Aug. 18, 1998 | (KR) | 98-033483 |
| Aug. 28, 1998 | (KR) | 98-035106 |
| Aug. 31, 1998 | (KR) | 98-035708 |
| Dec. 29, 1998 | (KR) | 98-059760 |
| Apr. 14, 1999 | (KR) | 99-013088 |

(51) Int. Cl.
*D06F 23/04* (2006.01)

(52) U.S. Cl. ..... 68/23.3; 68/132; 68/148

(58) Field of Classification Search ..... 68/19.1, 68/23 R, 23.3, 23.6, 132, 148
See application file for complete search history.

(56) References Cited

U.S. PATENT DOCUMENTS 1,234,498 A * 7/1917 Seymour ..... 68/18 F (Continued)

FOREIGN PATENT DOCUMENTS

CN 1134995 11/1996

(Continued)

*Primary Examiner*—Frankie L. Stinson
(74) *Attorney, Agent, or Firm*—Ked & Associates, LLP

(57) ABSTRACT

A washing machine is provided. The washing machine includes an outer tub configured to store washing water, an inner tub rotatably mounted in the outer tub, a pulsator configured to form a water circulation for washing laundry, and a motor installed under the outer tub and configured to rotate the inner tub and the pulsator. The motor is configured to vary a rotation speed of the inner tub and the pulsator, such that the laundry is washed by a combination of modes. The modes including a centrifugal force washing mode, wherein the motor rotates the inner tub and the pulsator in the same direction for a first predetermined period of time, thereby creating a centrifugal force that is varied according to a variation of the ratation speed, which pushes the laundry against a wall of the inner tub, and an agitation washing mode, wherein the motor rotates the inner tub and the pulsator in the same direction at an identical speed, and then rotates the inner tub and the pulsator in a first direction for a second predetermined period of time and than in a second, reverse direction for the second predetermined period of time.

6 Claims, 38 Drawing Sheets

U.S. PATENT DOCUMENTS

| | | | | | |
|---|---|---|---|---|---|
| 1,496,644 | A | * | 6/1924 | Karasinski | 68/148 |
| 1,850,138 | A | * | 3/1932 | Riall | 68/148 |
| 1,925,038 | A | * | 8/1933 | Reddig | 68/26 |
| 1,971,979 | A | * | 8/1934 | Hitchcock | 68/151 |
| 2,119,918 | A | * | 6/1938 | Kirby | 68/23.5 |
| 2,261,932 | A | * | 11/1941 | Bukolt | 68/151 |
| 2,556,153 | A | * | 6/1951 | Collins | 68/20 |
| 2,584,833 | A | * | 2/1952 | Beucler | 68/18 F |
| 2,630,001 | A | * | 3/1953 | Criner | 68/23.5 |
| 2,656,702 | A | * | 10/1953 | Chapin | 68/154 |
| 2,700,473 | A | * | 1/1955 | Emmert et al. | 34/319 |
| 2,703,974 | A | * | 3/1955 | Clark | 68/23.3 |
| 2,930,216 | A | * | 3/1960 | Cazzaniga | 68/23.3 |
| 3,603,118 | A | | 9/1971 | Brucken et al. | |
| 3,740,975 | A | * | 6/1973 | Cornelius | 68/18 F |
| 3,875,770 | A | * | 4/1975 | Brimer et al. | 68/23.7 |
| 4,395,890 | A | | 8/1983 | Goodlaxson | 68/23.7 |
| 4,464,914 | A | | 8/1984 | Torita | 68/23.5 |
| 4,584,732 | A | | 4/1986 | Kohsaka | 8/159 |
| 4,784,666 | A | * | 11/1988 | Brenner et al. | 8/137 |
| 4,791,691 | A | | 12/1988 | Fukuzawa et al. | |
| 4,809,524 | A | | 3/1989 | Sickert et al. | |
| 5,150,588 | A | * | 9/1992 | Singh | 68/23.5 |
| 5,167,722 | A | * | 12/1992 | Pastryk et al. | 134/33 |
| 5,191,667 | A | | 3/1993 | Roy et al. | |
| 5,325,677 | A | | 7/1994 | Payne et al. | |
| 5,457,970 | A | * | 10/1995 | Gutkin | 68/23.5 |
| 5,493,745 | A | | 2/1996 | Hauch | |
| 5,509,283 | A | | 4/1996 | Lee et al. | |
| 5,560,061 | A | | 10/1996 | Wentzlaff et al. | |
| 5,582,039 | A | | 12/1996 | Mueller et al. | |
| 5,617,747 | A | * | 4/1997 | Kim | 68/53 |
| 5,657,650 | A | | 8/1997 | Lee et al. | |
| 5,692,259 | A | | 12/1997 | Lee et al. | |
| 5,743,115 | A | | 4/1998 | Hashimoto | |
| 5,842,358 | A | * | 12/1998 | Koo et al. | 68/23.7 |
| 6,058,743 | A | | 5/2000 | Fujii et al. | |
| 6,065,171 | A | | 5/2000 | Tubman et al. | |
| 6,082,152 | A | * | 7/2000 | Im | 68/23.7 |
| 6,134,925 | A | | 10/2000 | Fujii et al. | |
| 6,145,350 | A | * | 11/2000 | Hwang | 68/18 F |
| 6,247,339 | B1 | | 6/2001 | Kenjo et al. | |

FOREIGN PATENT DOCUMENTS

| | | |
|---|---|---|
| FR | 1016453 | 11/1959 |
| JP | 52-97269 | 8/1977 |
| JP | 54-100155 | 8/1979 |
| JP | 54-122663 | 8/1979 |
| JP | 59-151591 | 10/1984 |
| JP | 60-45393 | 3/1985 |
| JP | 60-142893 | 7/1985 |
| JP | 08-024475 | 1/1996 |

* cited by examiner

PENETRATION TYPE WASHING MACHINE, METHOD FOR CONTROLLING THE SAME, AND TUB COVER

This application is a Continuation of application Ser. No. 10/052,246, filed Jan. 23, 2002, now U.S. Pat. No. 6,668,410 which is a Divisional of application Ser. No. 09/376,375 filed Aug. 18, 1999, now U.S. Pat. No. 6,351,974 the entire disclosure of which is hereby incorporated by reference.

BACKGROUND OF THE INVENTION

1. Field of the Invention

The present invention relates to a full automatic washing machine, and more particularly, to a penetration type washing machine which makes washing by penetrating washing water through laundry; a method for controlling the same; and, a tub cover for the same.

2. Background of the Related Art

Being a device for peeling off contaminant by applying energies, such as impact, to the laundry, there are pulsator washing machines, drum washing machines, agitator washing machine, and the like according to types of energy application. Washing of the laundry is made by applying impacts to the laundry using pulsator or agitator, or dropping the laundry using rotation of the drum.

FIG. 1 illustrates a cross section of a related art pulsator type washing machine, referring to which a related art pulsator type washing machine will be explained.

There is an inner tub 3 having a plurality of washing holes 5 formed therein rotatably mounted inside of an outer tub 2 provided for storage of washing water, inside of which inner tub 3 there is a pulsator 4 rotatably mounted therein. There is a drain valve 9 under the outer tub 2 for draining the washing water outside of the washing machine. A rotation power from a motor 8 mounted on an underside of the outer tub 2 is transmitted to a dewatering shaft 6*a* coupled to the inner tub 3 and the washing shaft 6 coupled to the pulsator 4, for rotating the inner tub 3 and the pulsator 4. The washing shaft 6 and the dewatering shaft 6*a* are coupled/decoupled by a clutch 7.

There is a tub cover 11 on the outer tub 2, which will be explained with reference to FIG. 2. The tub cover 11, of substantially an annular form, has an upper surface portion 11*a* disposed on top both of the outer tub 2 and the inner tub 3, a tight fit portion 11*b* extended in an upper and a lower direction from an end of the upper surface portion 11*a* for tight fit to an inside surface of the outer tub 2, and a fastening portion 11*c* projected from the tight fit portion 11*b* in a substantially vertical direction for being fastened to the outer tub 2 with screws 14. The tub cover 110 is provided for prevention of noise and overflow of foam as well as prevention of infiltration of foreign matters into a space between the inner tub and the outer tub.

The operation of the aforementioned related art pulsator type washing machine will be explained with reference to FIGS. 1 and 2.

The washing machine is operative in a washing cycle, a rinsing cycle, and a dewatering cycle, by proceeding through each of which mode in a sequence the washing can be done. In the washing cycle, upon putting the washing machine into operation after placing the laundry in the inner tub 3, the washing water is supplied until it fills to certain levels of the inner tub 3 and the outer tub 2. Upon finishing the water supply, the motor 8 makes intermittent rotations in regular and reverse directions in a state the inner tub 3 is standstill, that leads the pulsator 4 to rotate in the regular and reverse directions for washing the laundry. That is, the pulsator 4 repeats the regular/reverse direction rotation, to rotate the laundry in of the inner tub 3 and to form water circulation, as well. Then, the laundry is washed by the impact from the pulsator 4, the water circulation, friction with the inner tub 3, and softening effect of the detergent, and the like. After proceeding the washing cycle for a preset time period, the drain valve 9 is opened, to drain contaminated washing water to outside of the washing machine. Then, clean washing water is supplied to inside of the inner tub 3, and the pulsator 4 is rotated, to make rinsing cycles for a preset number of times. In the dewatering cycle, the inner tub 3 is rotated in a high speed together with the pulsator 4 in one direction in a state the washing shaft 6 and the dewatering shaft 6*a* are coupled. Consequently, the washing water is discharged to the outer tub 2 through the washing holes 5, and drained to outside of the washing machine through the drain valve 9.

However, the related art washing machines, making the washing mostly using mechanical energies, of such as pulsator or agitator, is required to have a rotating power of a certain speed for making an adequate washing, that causes entangle of or damage to the laundry. And, the related art washing machine is involved in an increased washing water and detergent consumed during the washing because the washing machine is operative under a state the washing water is filled in the inner tub and the outer tub, as well as an increased overall washing time period due to increased water supply and drain time periods, that are not directly related to the washing time period.

Accordingly, there has been researches for making washing without rubbing the laundry or applying impact to laundry, one of which is the penetration type washing machine. That is, according to what is known, if a relative flow speed of water passing through between textile fibers of the laundry is greater than a certain level, the water can make a washing, without rubbing or twisting the laundry. A washing machine employing such a principle is a penetration type washing machine. In general, as disclosed in U.S. Pat. No. 5,191,667, a related art penetration type washing machine is provided with a washing water sprayer for spraying the washing water to the laundry in an inner tub over a required speed, and a separate pump for pumping the washing water to the washing water sprayer. Therefore, the related art penetration type washing machine has problems in that a complicated system and a large sized pump for obtaining a spraying power for the washing are required. Therefore, the related art penetration type washing machine has been mostly used as a supplementary means for the pulsator type washing machine.

And, though JP S51-13416 discloses a washing machine which makes a penetration washing by rotating an inner tub, the washing machine has the following problems.

First, as the inner tub rotates only in one direction, the washing water penetrates a fixed position of the laundry, to cause a wash difference in which a washed portion and a non-washed portion are happened.

Second, the only use of penetration washing makes a washing efficiency poor. Because, though the penetration type washing machine can prevent damage to, and entangling of the laundry, in general, the washing efficiency is poor compared to the pulsator type washing machine.

Third, since the washing machine fails to provide a guide means for guiding the washing water to an inside surface of the inner tub when the washing water is pumped to an upper portion between the inner tub and the outer tub, and then, circulated into the inner tub, the washing machine has a poor pumping efficiency.

Use of a related art tub cover for the penetration type washing machine causes leakage of spray of the washing water. That is, as shown in FIG. 2, since the related art tub cover 11 is merely fastened to the outer tub 2 with screws 14, the washing water leaks through gaps between the tight fit portion 11*b* of the tub cover 11 and the outer tub, and the fastening portion 11*c* and a top of the outer tub 2. And, a pumped washing water splashes from an inside of the tub cover to outside of the outer tub 2, to generate noise as the splash hits a washing water case, and to deteriorate washing and rinsing performances of the washing machine as the splash causes a loss of the washing water. Moreover, the leaked or splashed washing water to outside of the outer tub 102 wets various electric components of the washing machine, that is liable to cause malfunction or disorder of the washing machine.

The above references are incorporated by reference herein where appropriate for appropriate teachings of additional or alternative details, features and/or technical background.

SUMMARY OF THE INVENTION

An object of the invention is to solve at least the above problems and/or disadvantages and to provide at least the advantages described hereinafter.

Accordingly, the present invention is directed a penetration type washing machine, a method for controlling the same, and a tub cover for the same that substantially obviates one or more of the problems due to limitations and disadvantages of the related art.

An object of the present invention is to provide a penetration type washing machine, and a method for controlling the same, which has a simple structure and can improve a washing efficiency.

Another object of the present invention is to provide a tub cover for use in a penetration type washing machine which can improve a pumping efficiency and a washing efficiency.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the method for controlling a full automatic washing machine, includes a washing cycle, a rinsing cycle, and a dewatering cycle, wherein the washing or the rinsing cycle includes the step of rotating an inner tub at a high speed higher than a preset speed in one direction, thereby making a centrifugal force caused by high speed rotation of the inner tub, to push laundry against a wall of the inner tub, to enforce washing water in the inner tub to penetrate through the laundry at a speed higher than required to make the washing done, and to pump the washing water penetrated through the laundry and discharged into an outer tub upward, to recirculate to the inner tub.

In other aspect of the present invention, there is provided a tub cover mounted on a top of an outer tub of a washing machine for preventing noise and foam overflow, including an upper tub cover for being fastened to the outer tub, and a lower tub cover under the upper tub cover spaced therefrom for being fastened to the upper tub cover, thereby forming washing water passages between the upper tub cover and the lower tub cover.

It is to be understood that both the foregoing general description and the following detailed description are exemplary and explanatory and are intended to provide further explanation of the invention as claimed.

Additional advantages, objects, and features of the invention will be set forth in part in the description which follows and in part will become apparent to those having ordinary skill in the art upon examination of the following or may be learned from practice of the invention. The objects and advantages of the invention may be realized and attained as particularly pointed out in the appended claims.

BRIEF DESCRIPTION OF THE DRAWINGS

The invention will be described in detail with reference to the following drawings in which like reference numerals refer to like elements wherein:

The accompanying drawings, which are included to provide a further understanding of the invention and are incorporated in and constitute a part of this specification, illustrate embodiments of the invention and together with the description serve to explain the principles of the invention:

In the drawings:

FIG. 1 illustrates a section of a related art pulsator type washing machine;

FIG. 2 illustrates a section showing an enlarged view of "A" part in FIG. 1;

Figure 1:
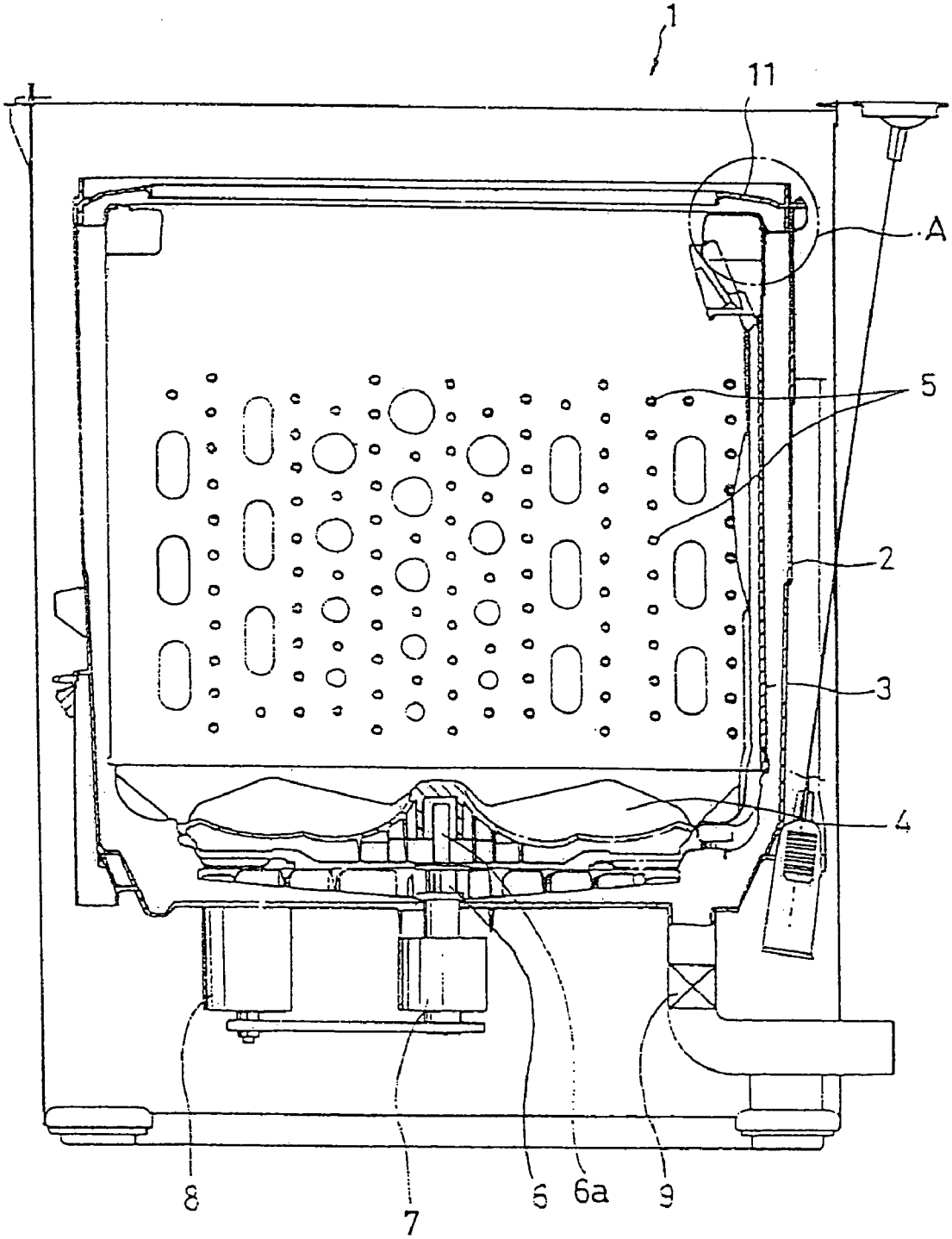
FIG.1 Related Art
Figure 2:
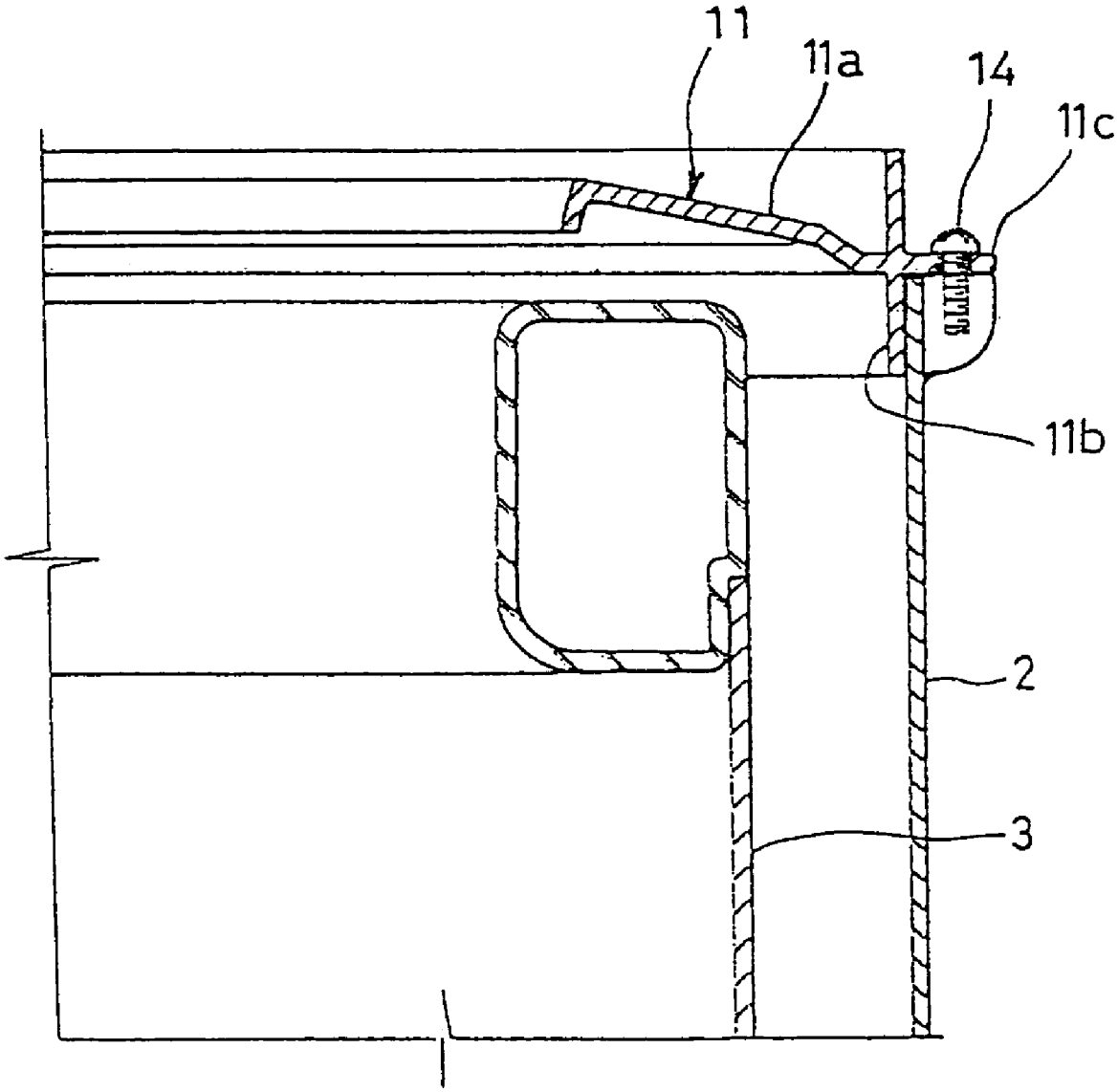
FIG.2 Related Art
Figure 3A:
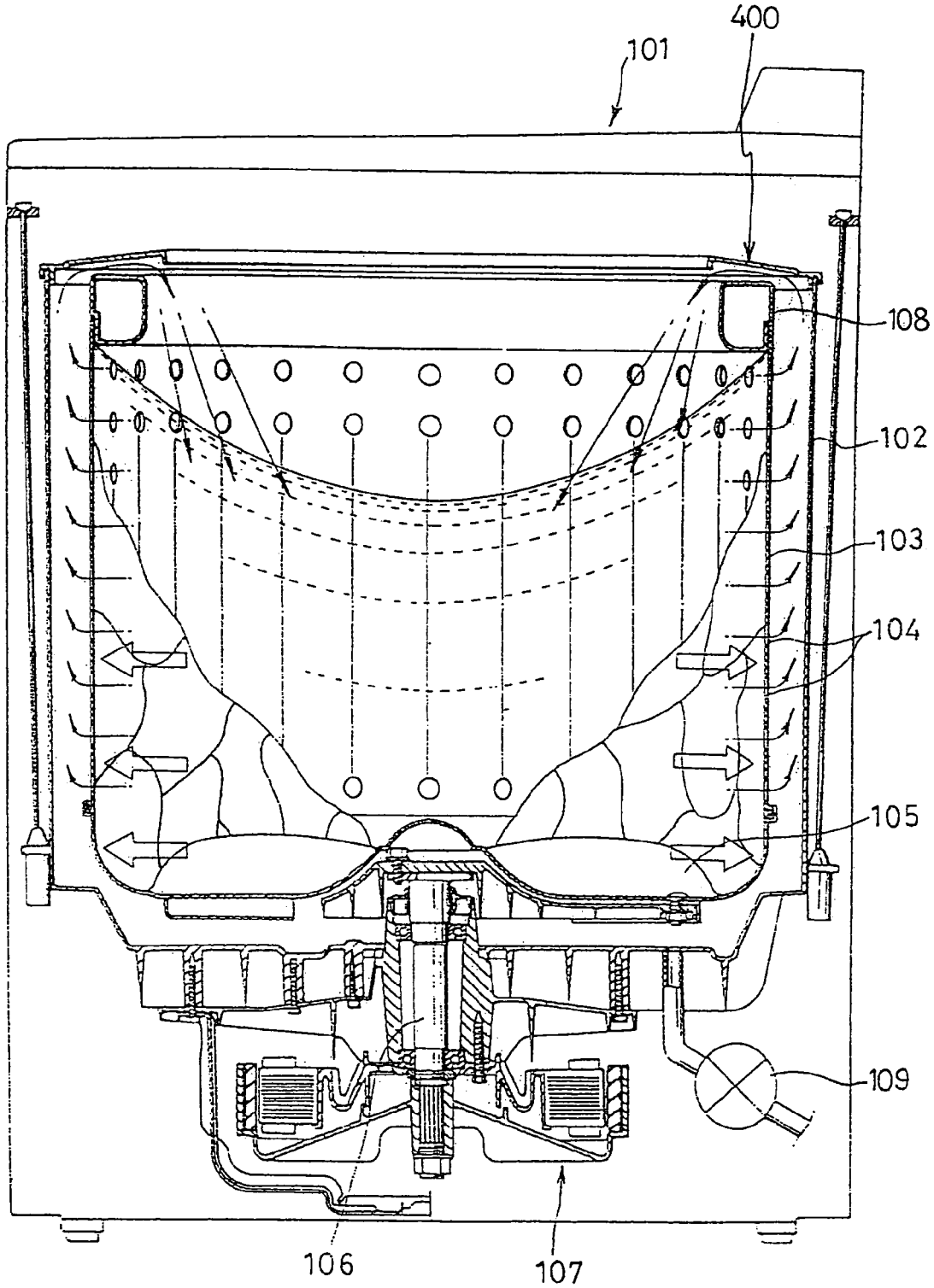
Figure 3B:
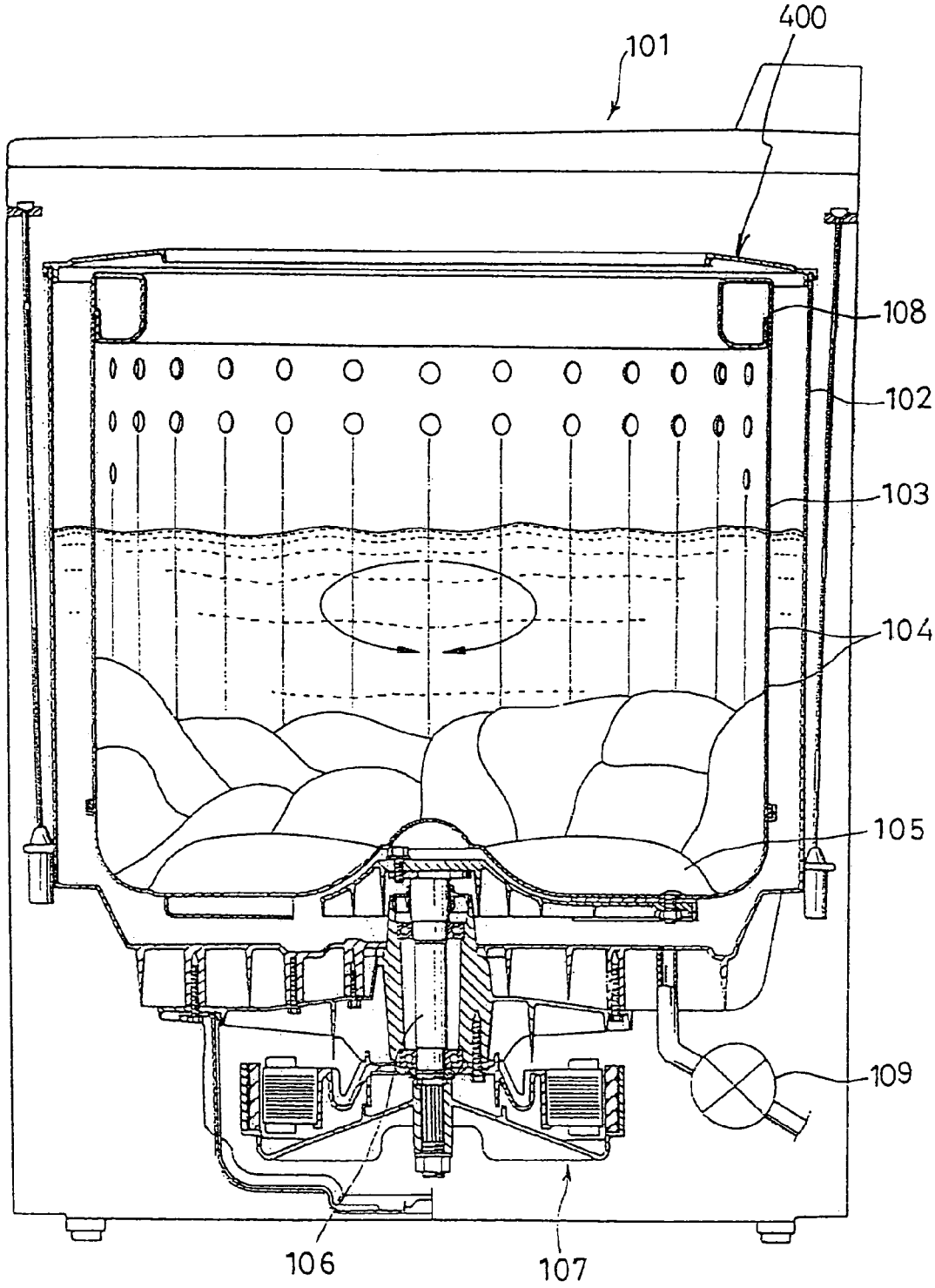
Figure 3C:
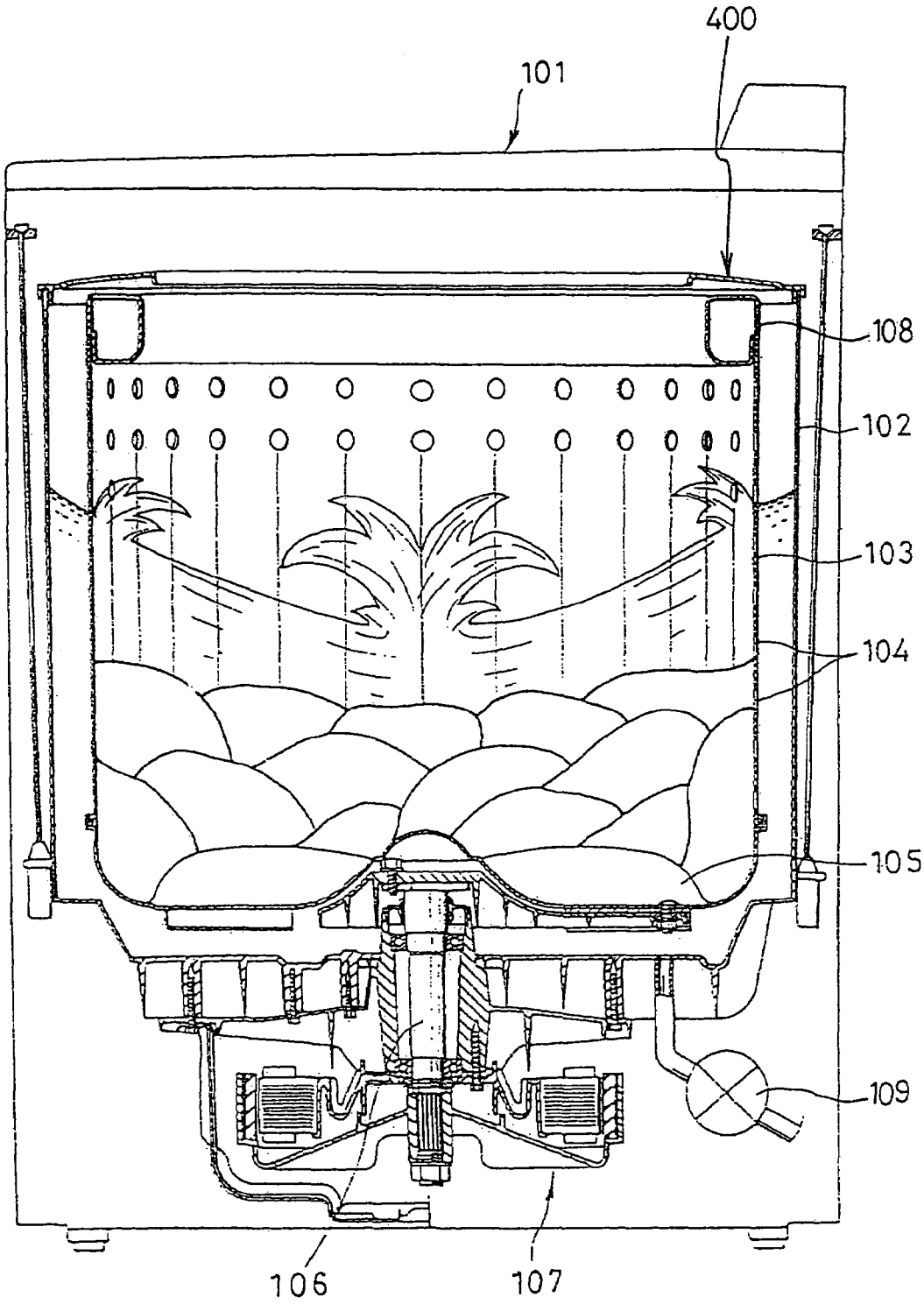
Figure 4:
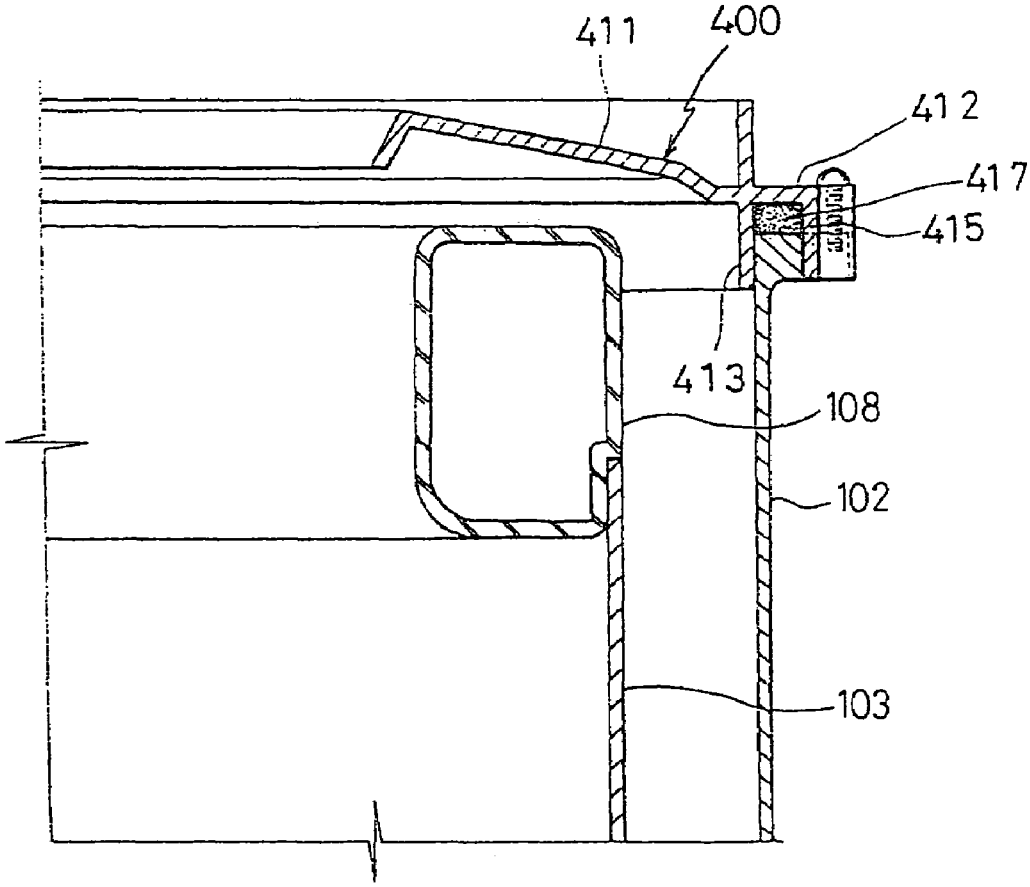
Figure 5:
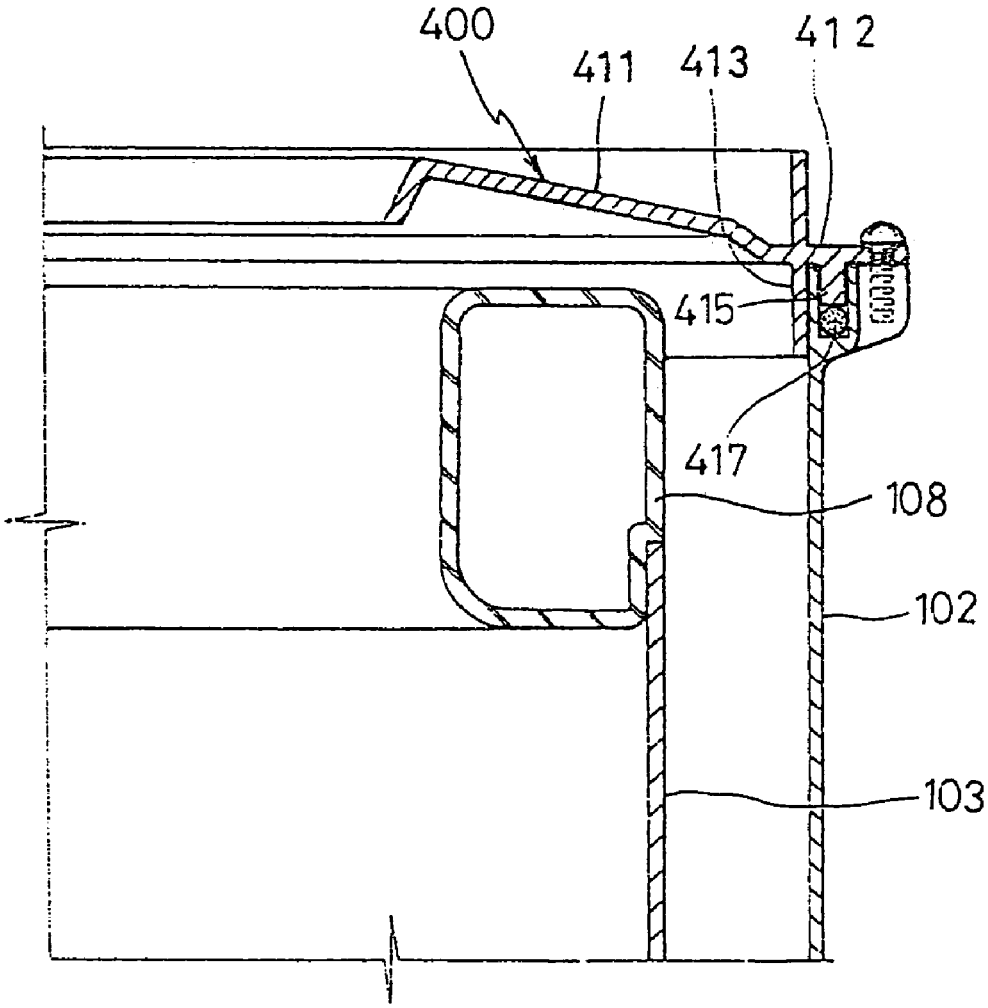
Figure 6:
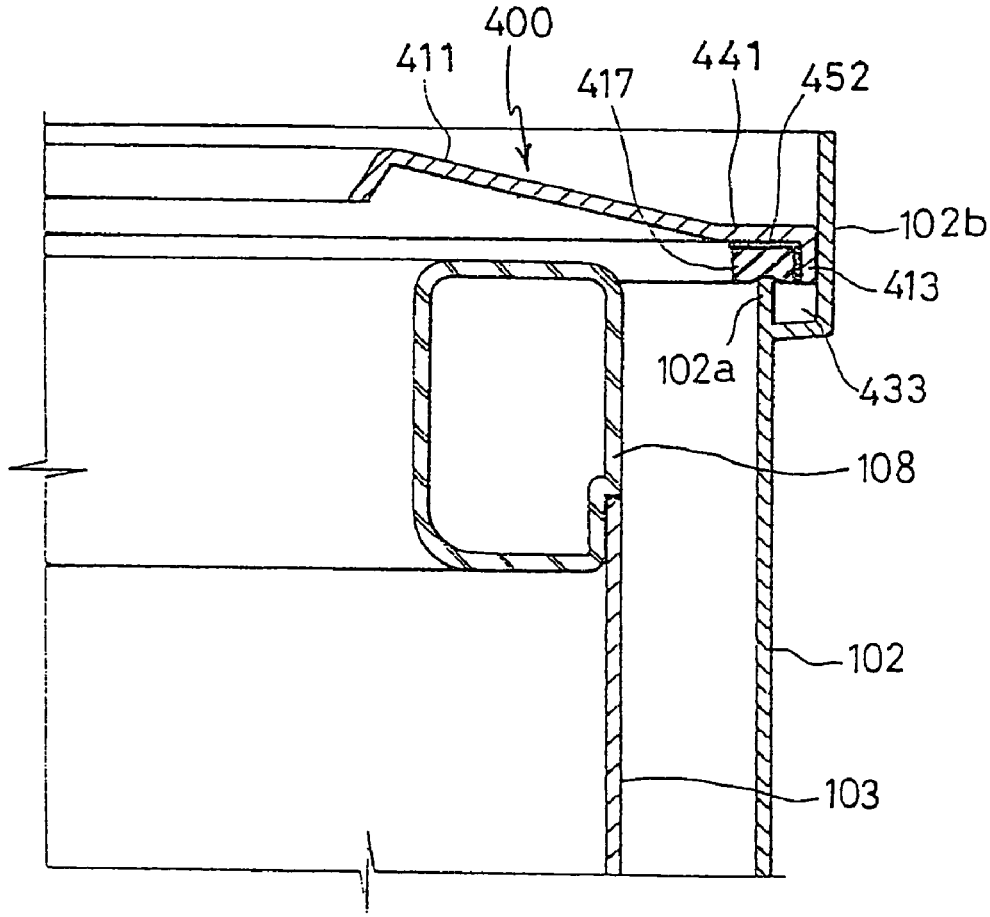
Figure 7:
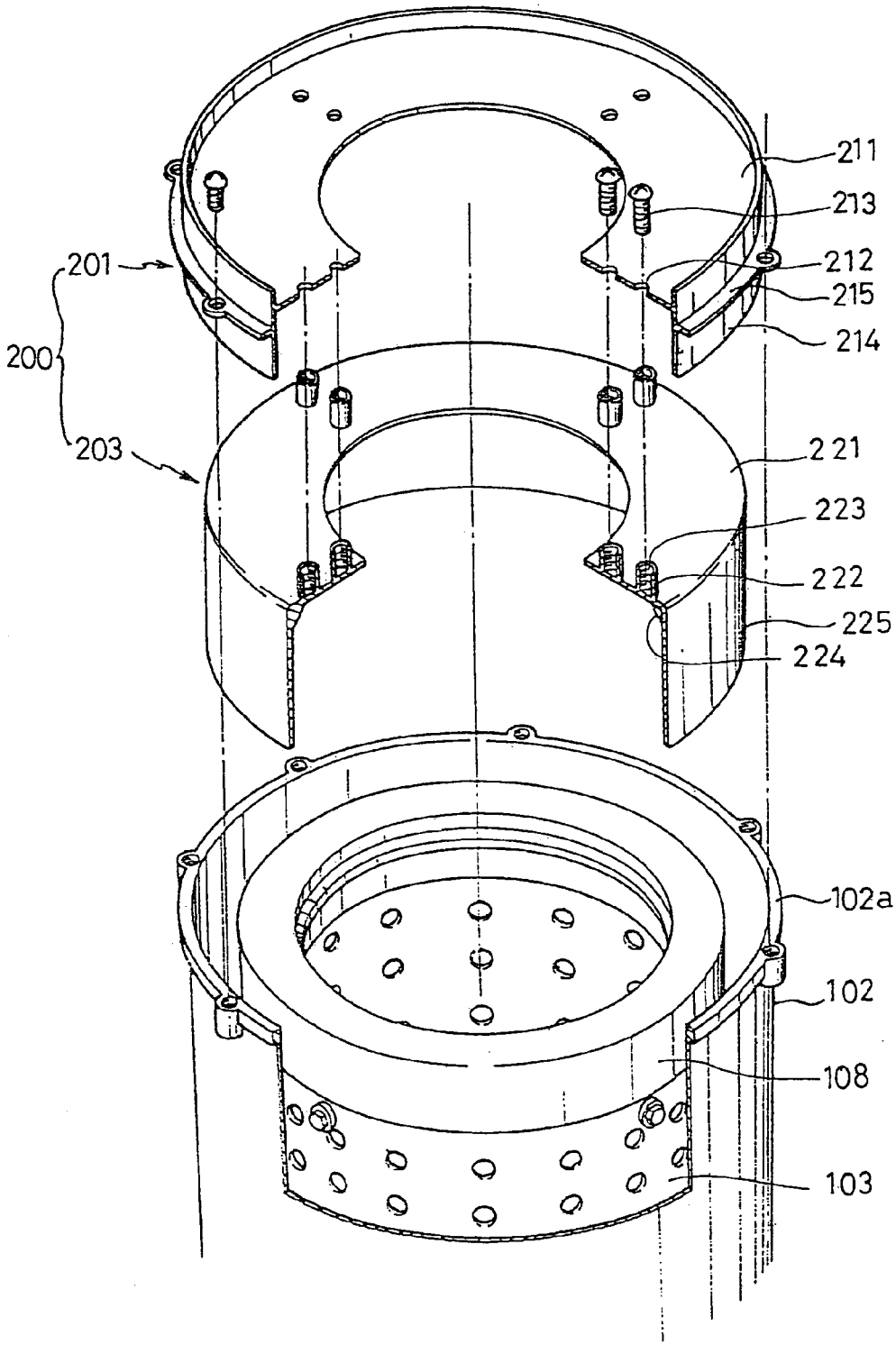
Figure 8:
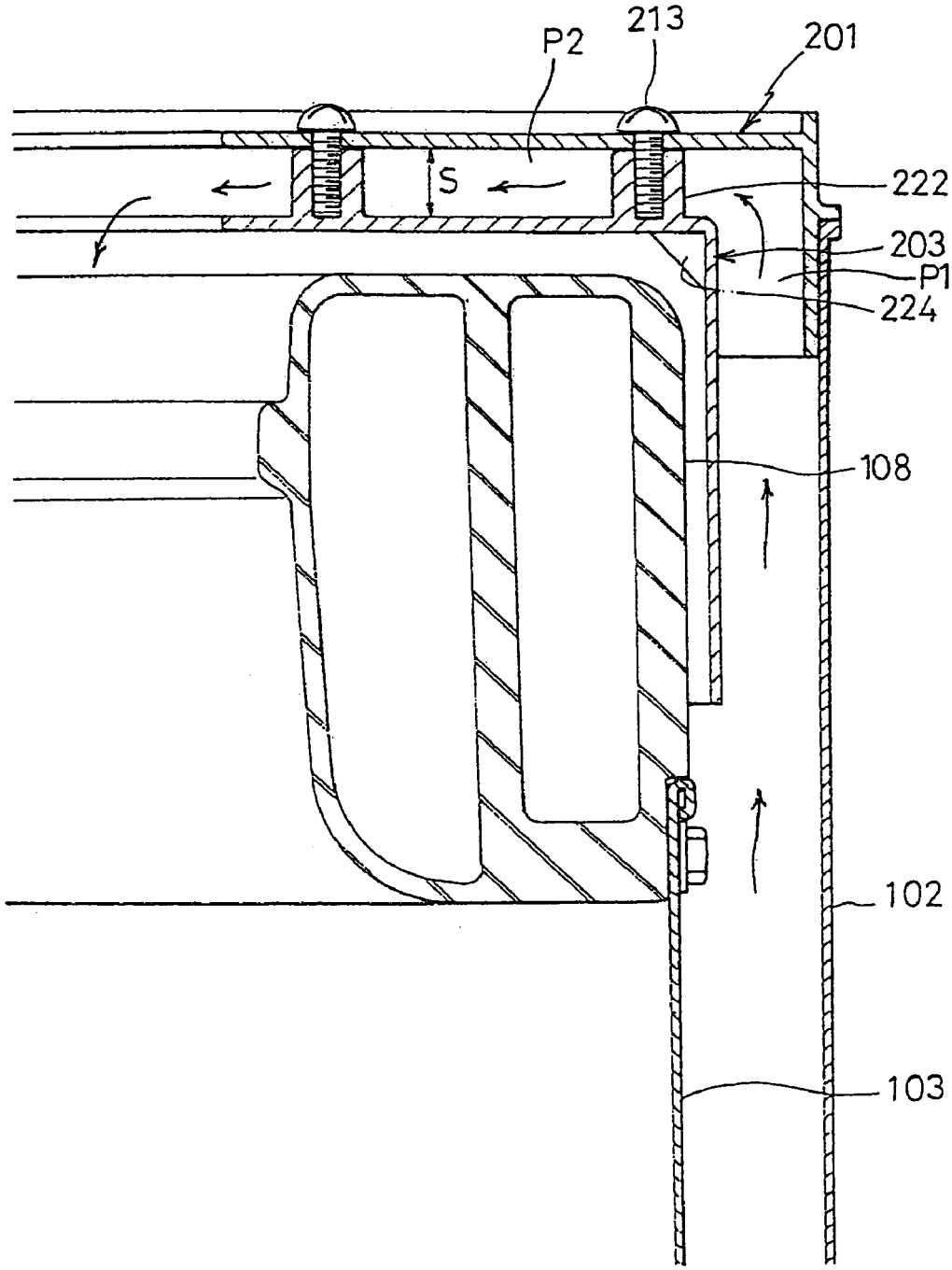
Figure 9:
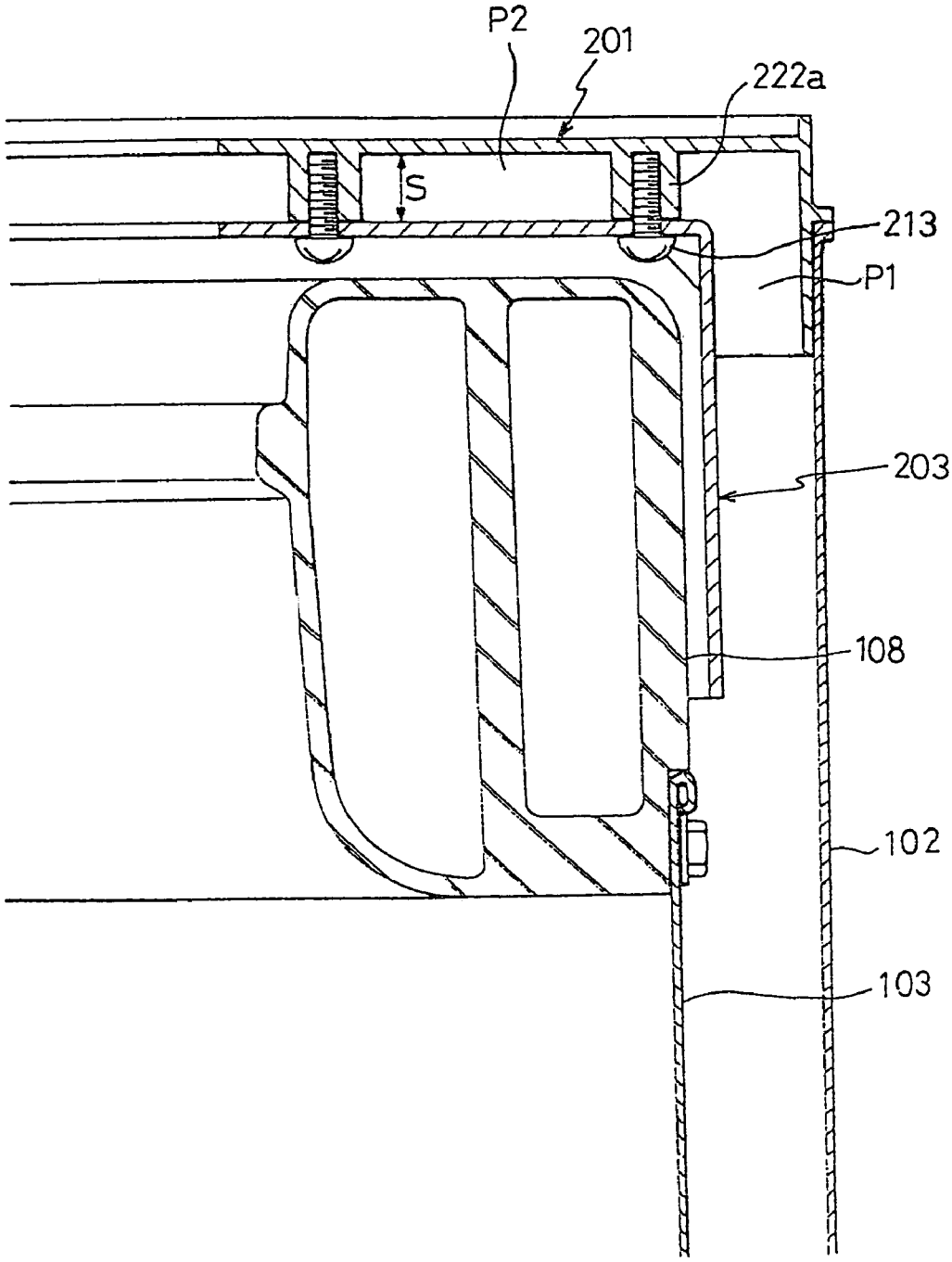
Figure 10:
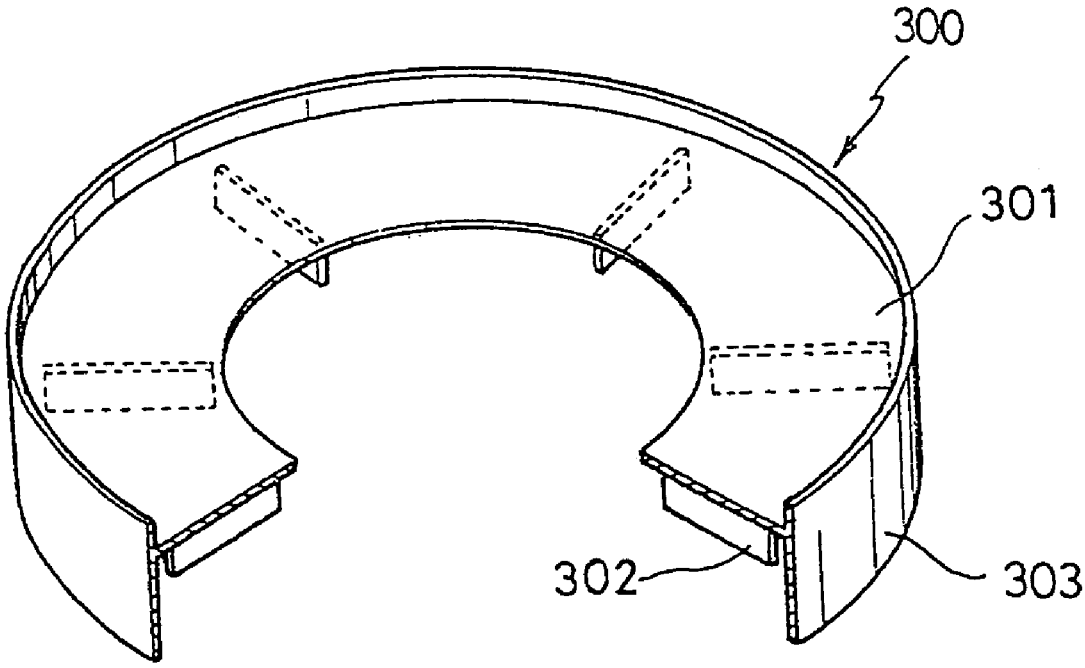
Figure 11:
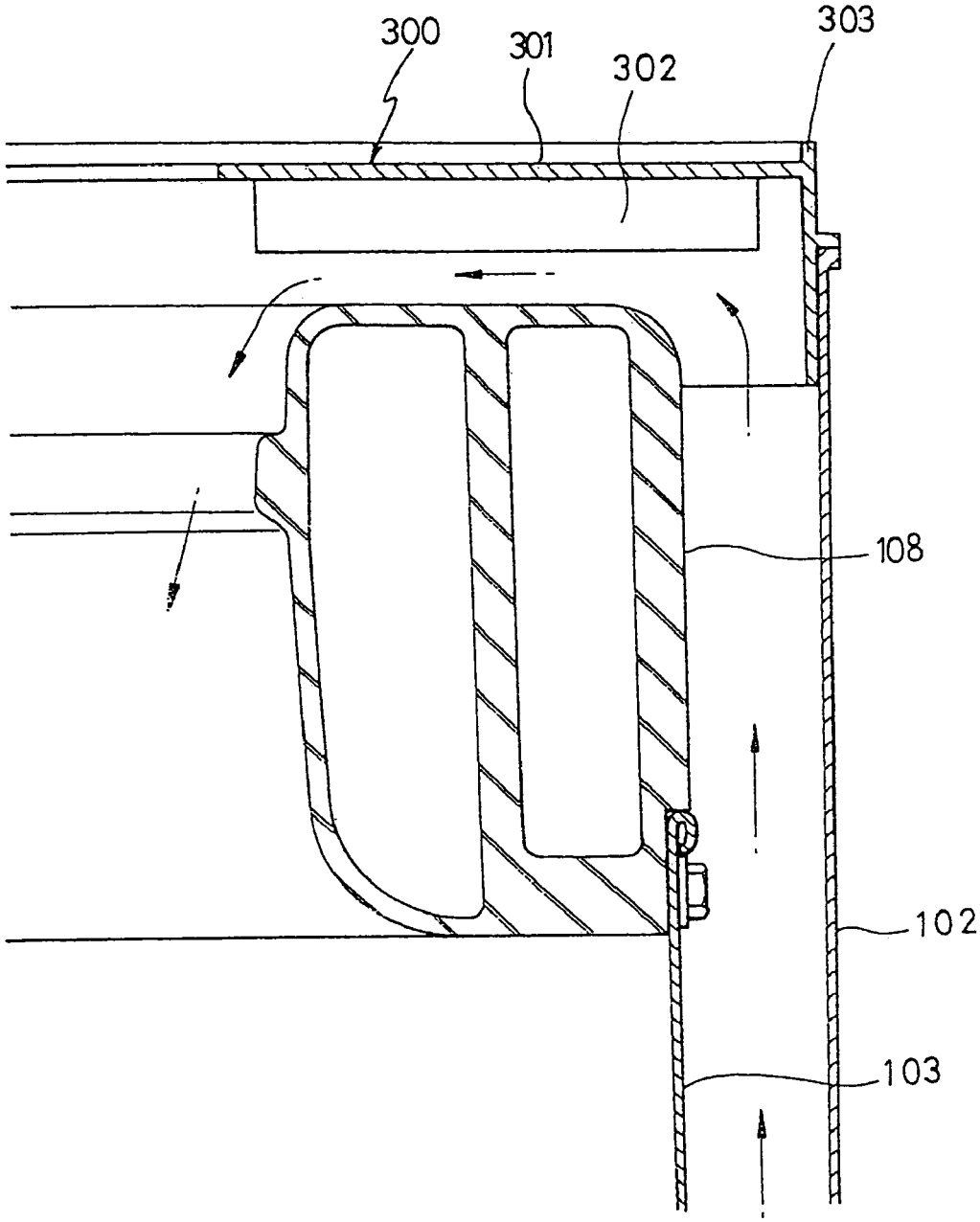
Figure 12:
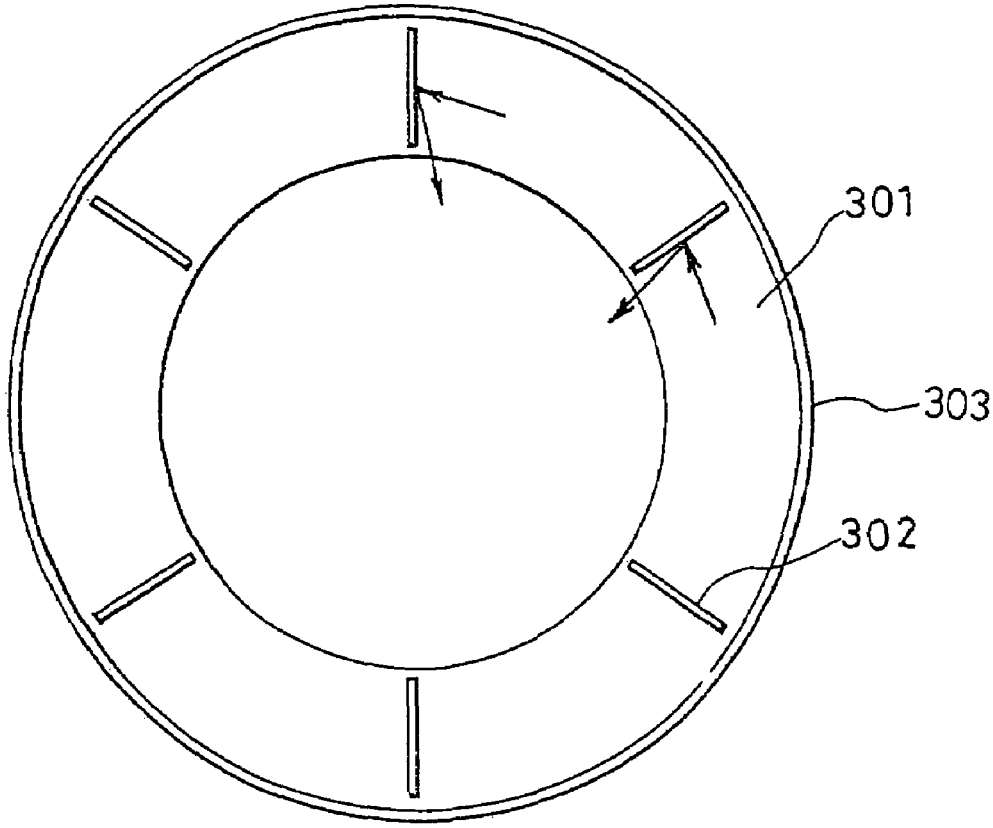
Figure 13:
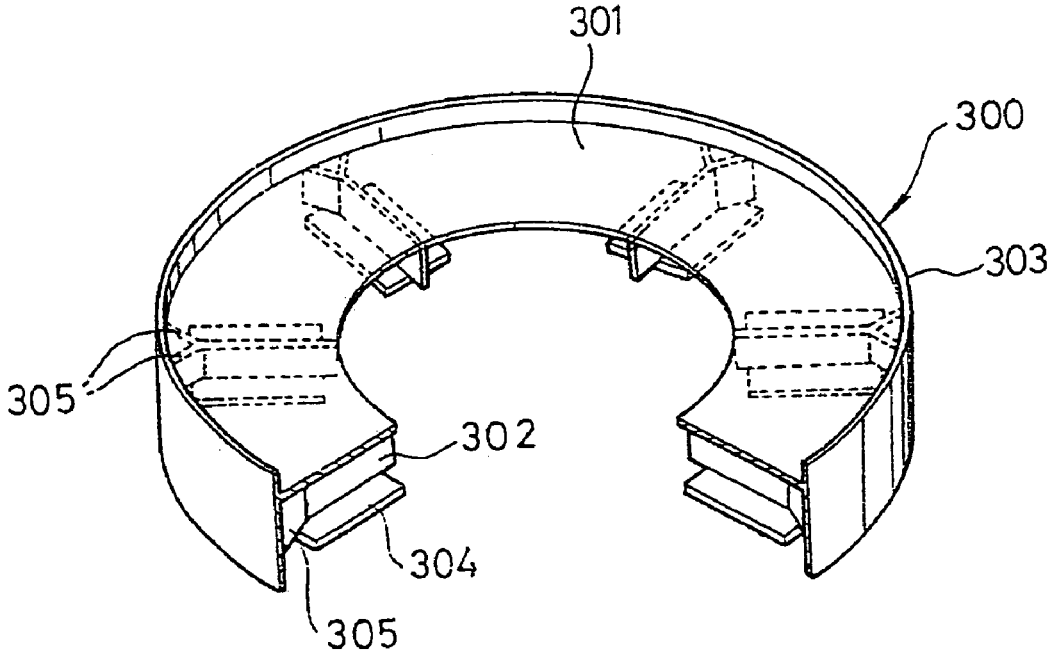
Figure 14:
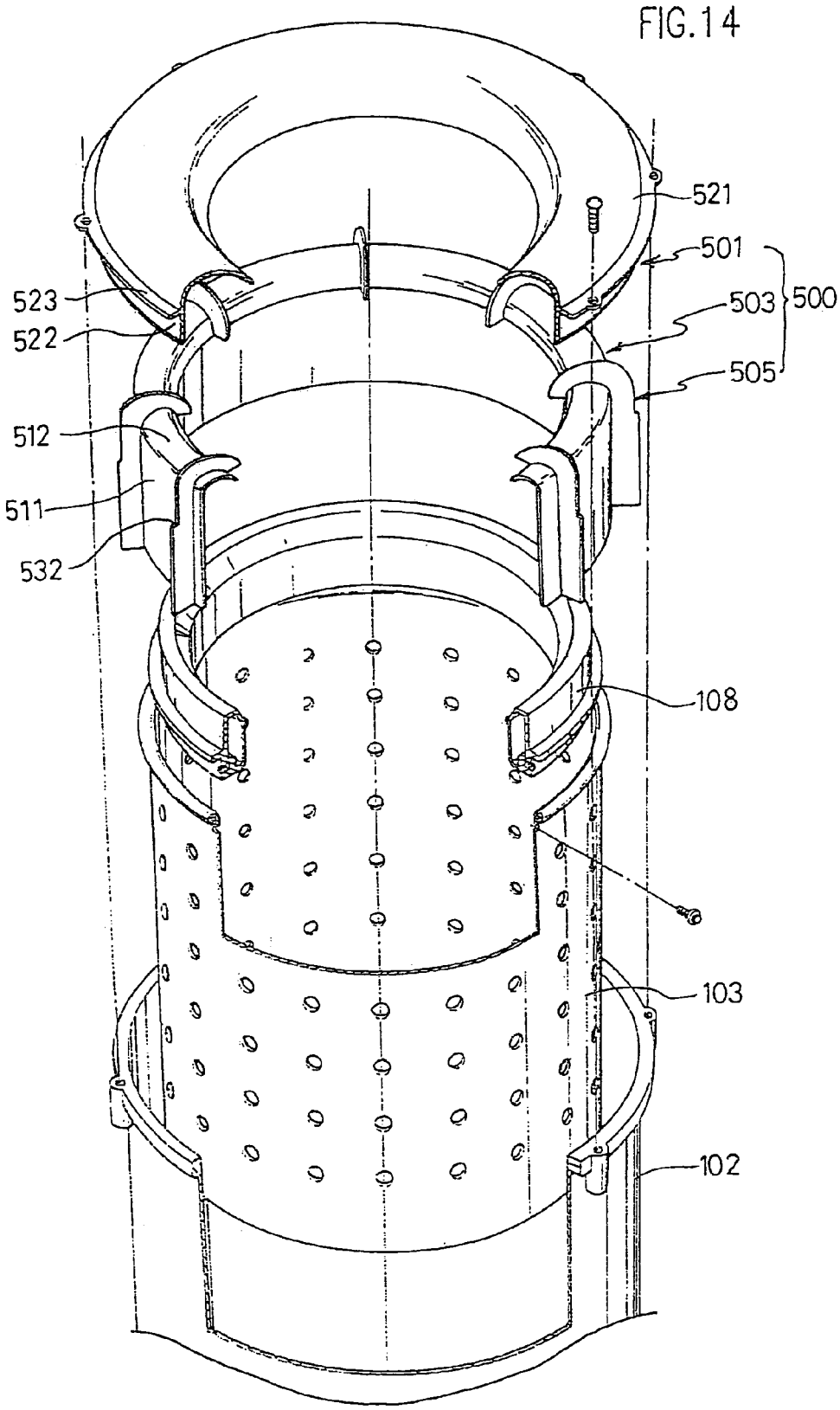
Figure 15:
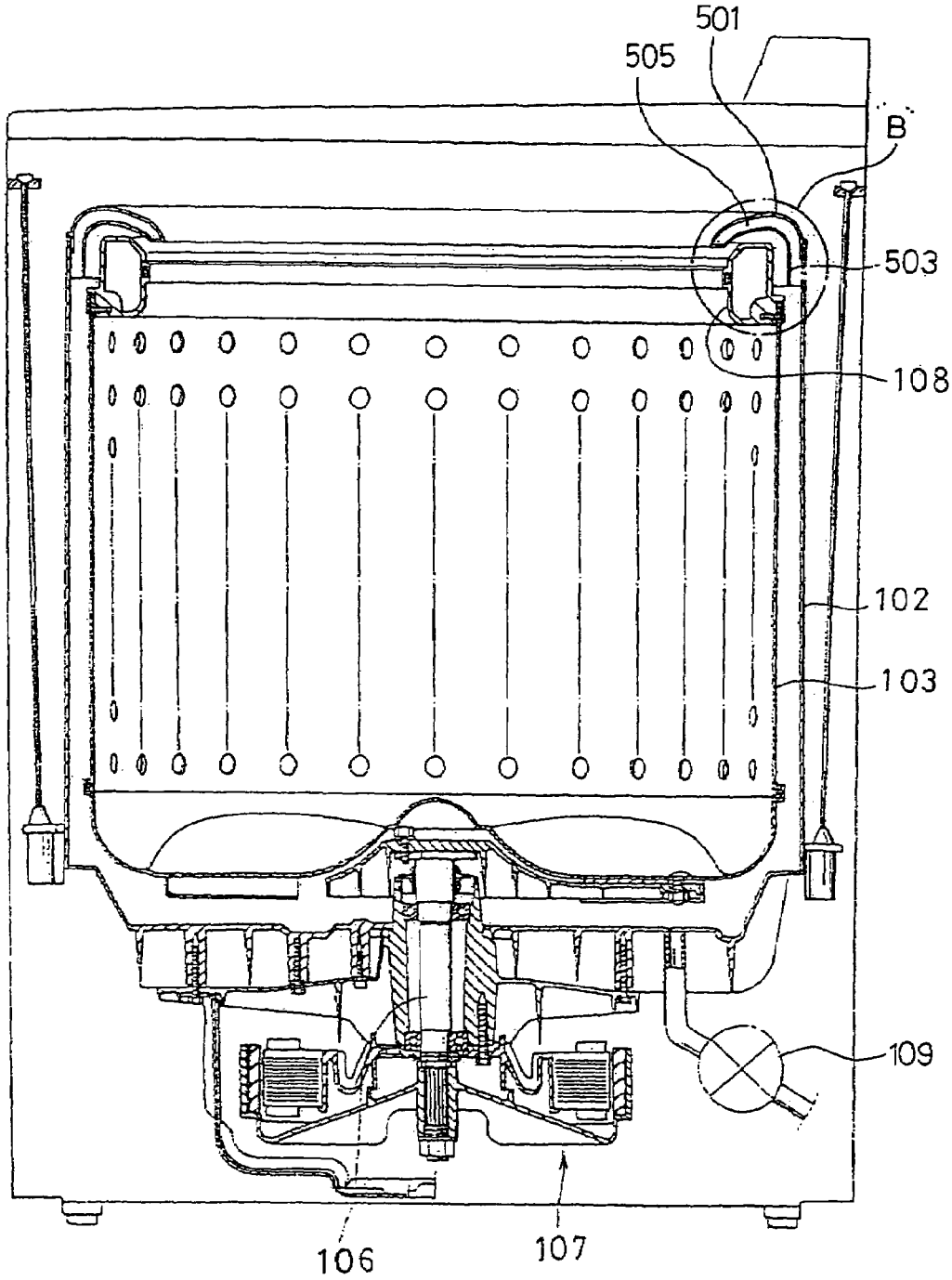
Figure 16:
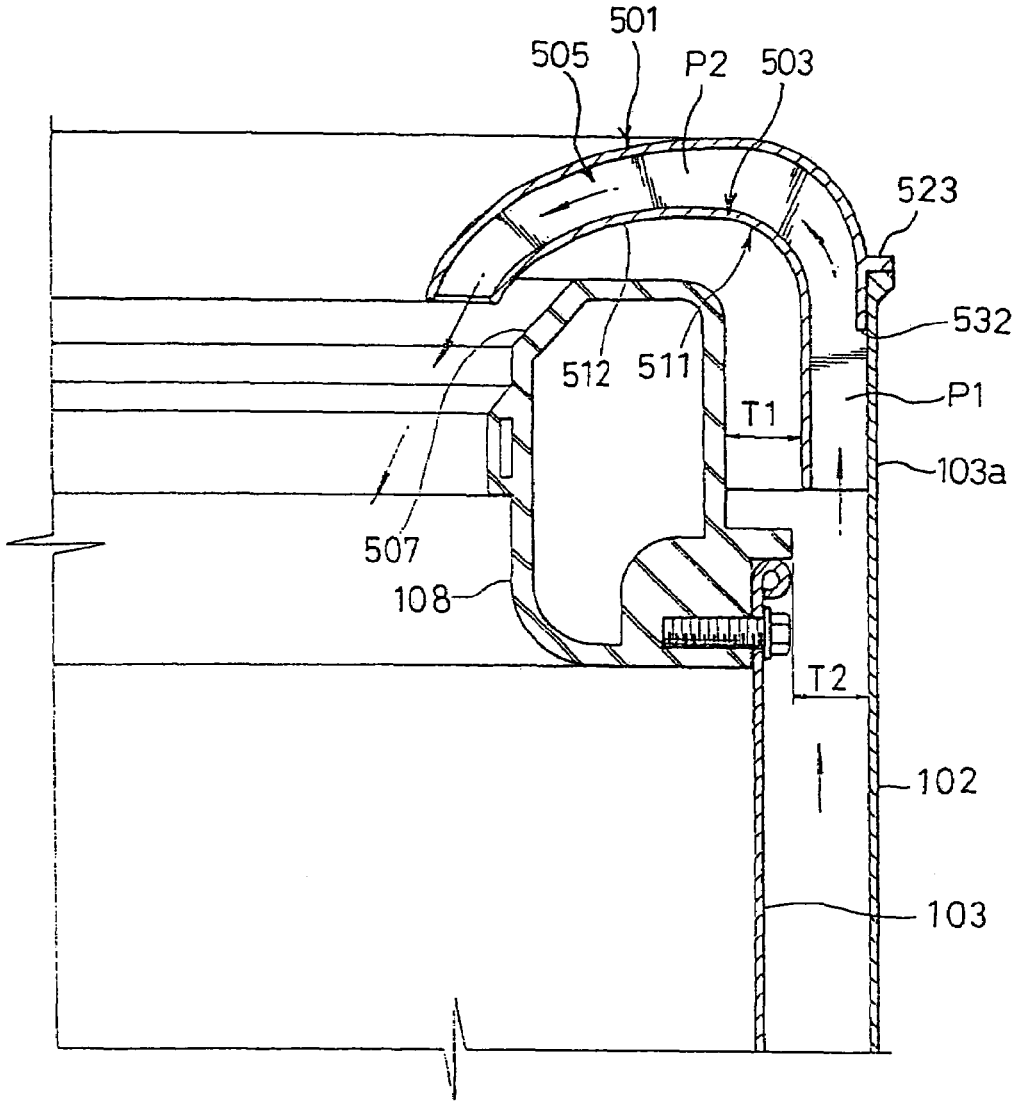
Figure 17:
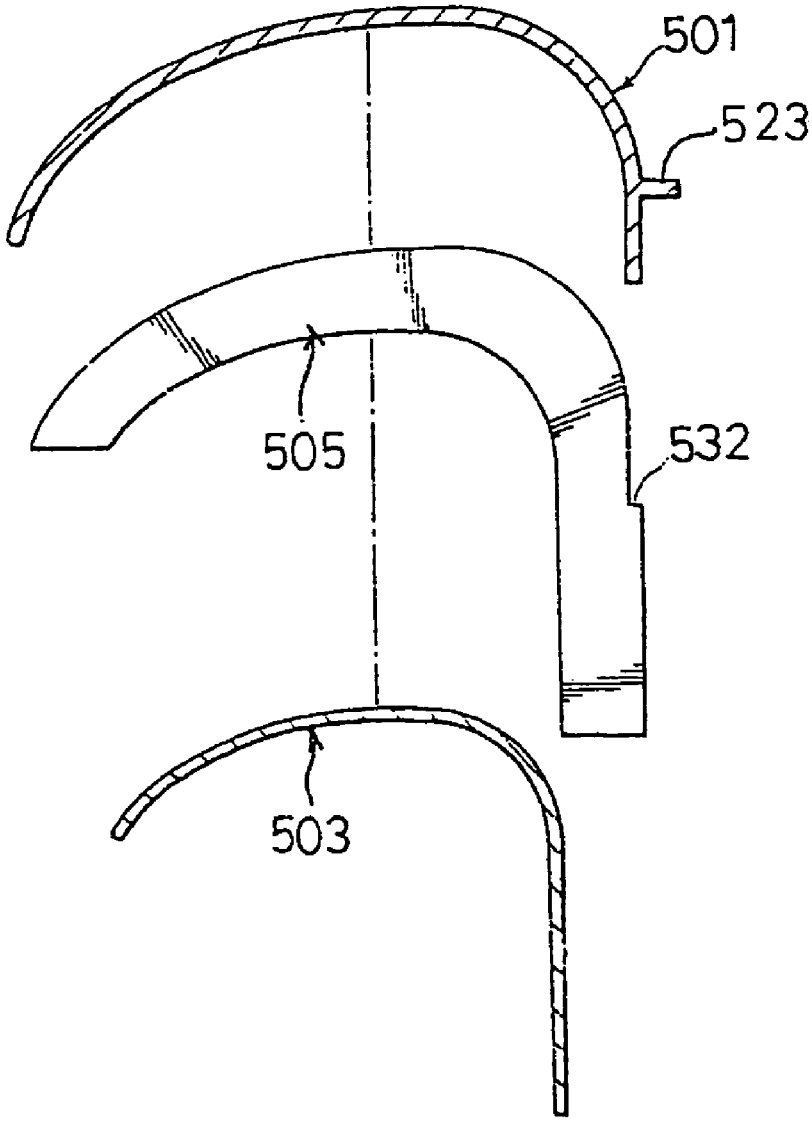
Figure 18:
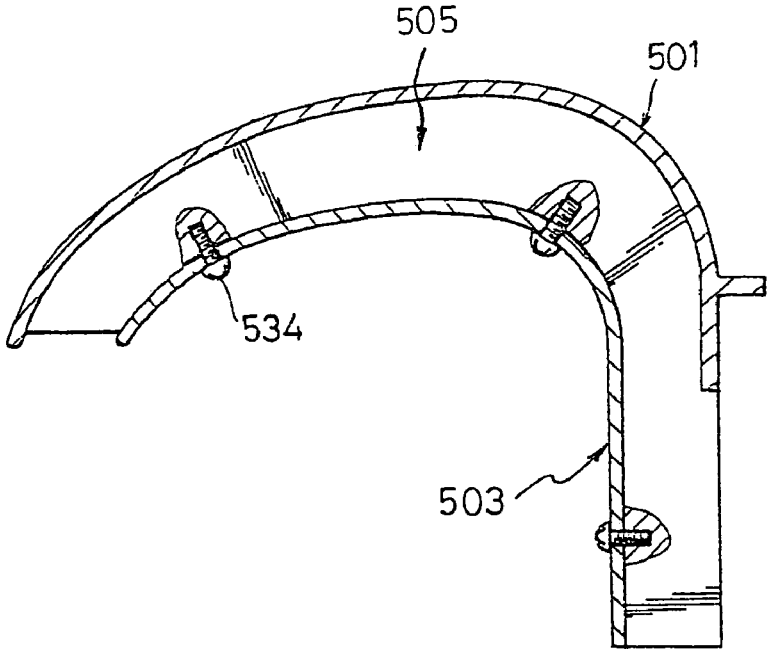
Figure 19:
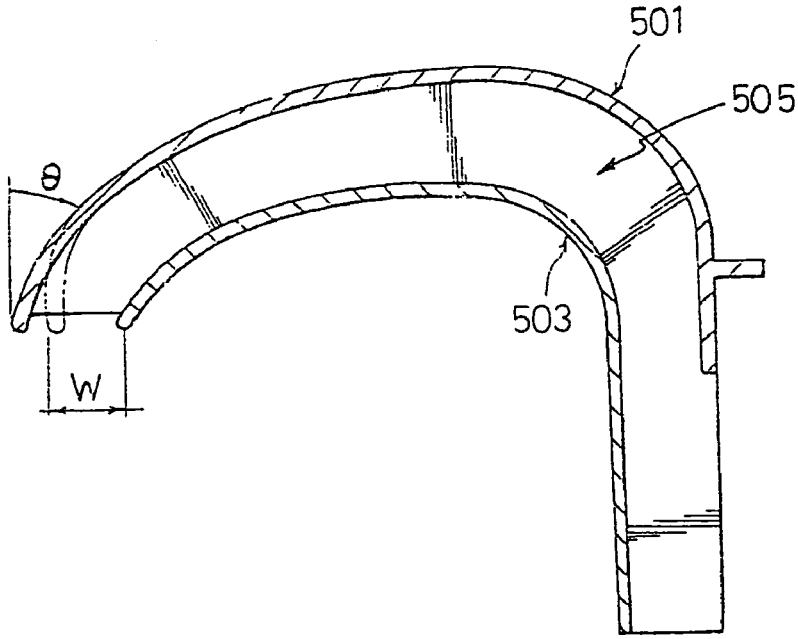
Figure 23:
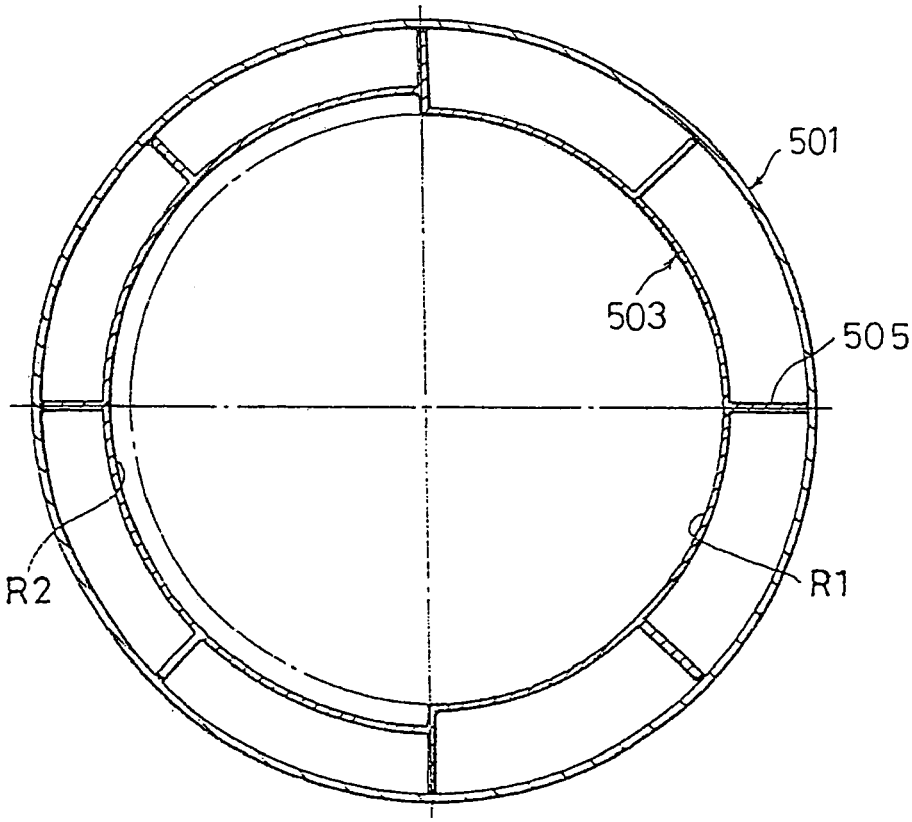
Figure 24:
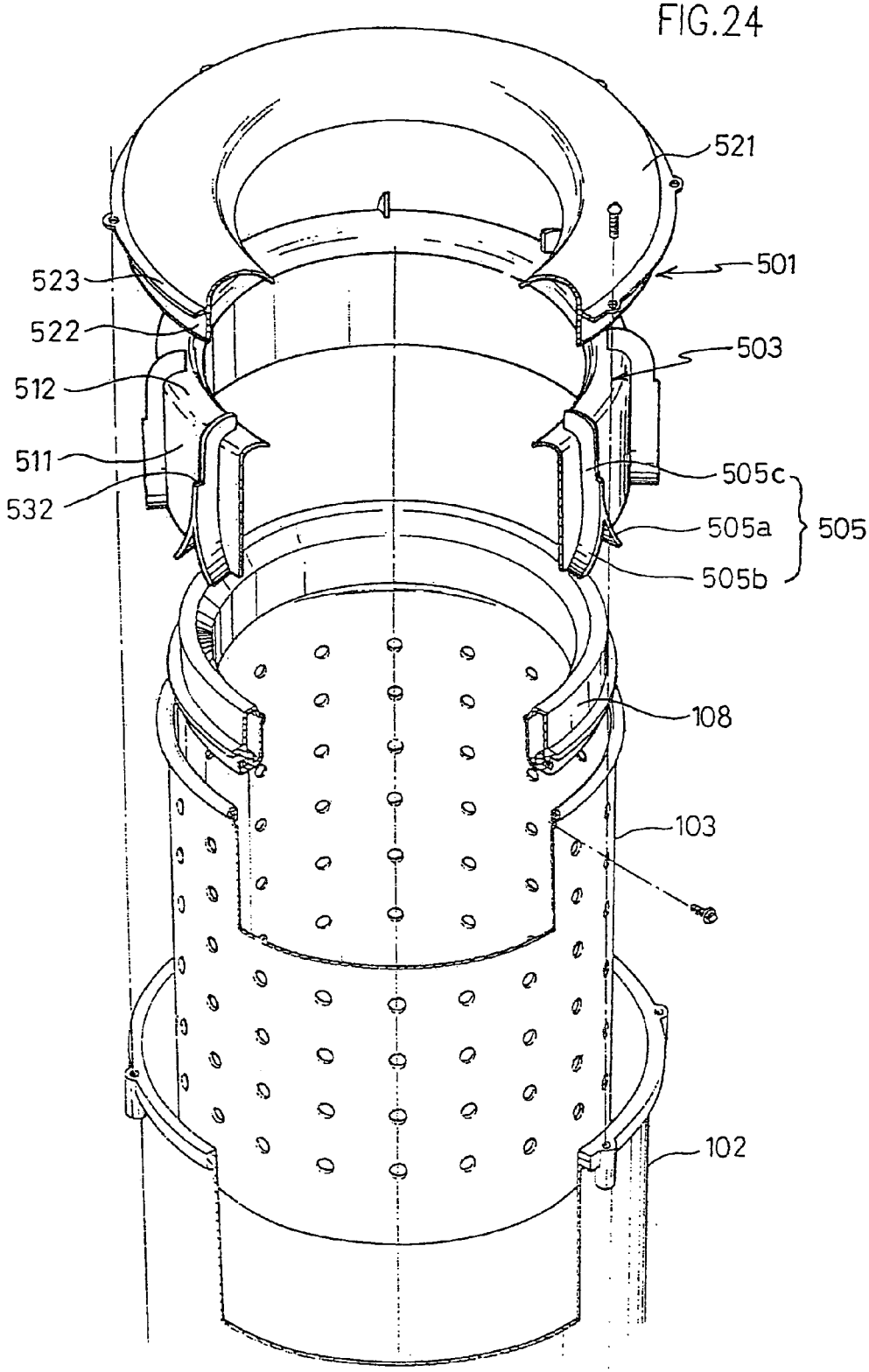
Figure 25:
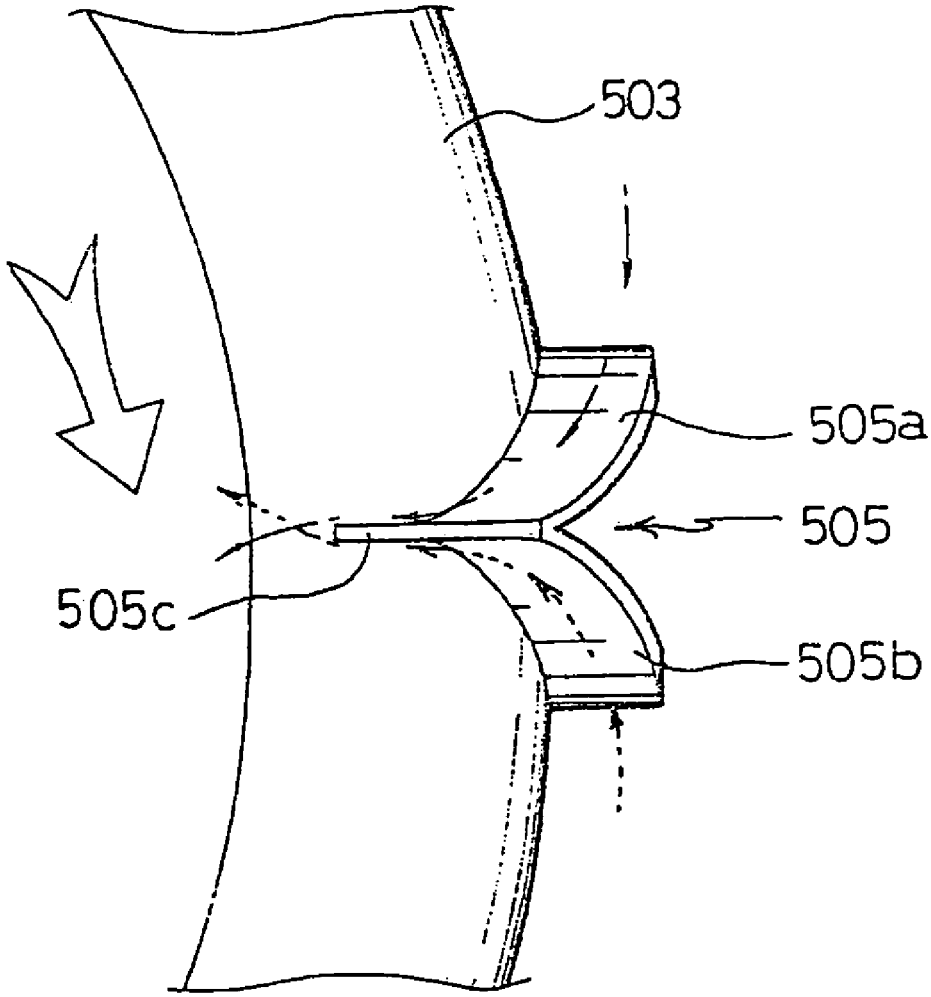
Figure 26:
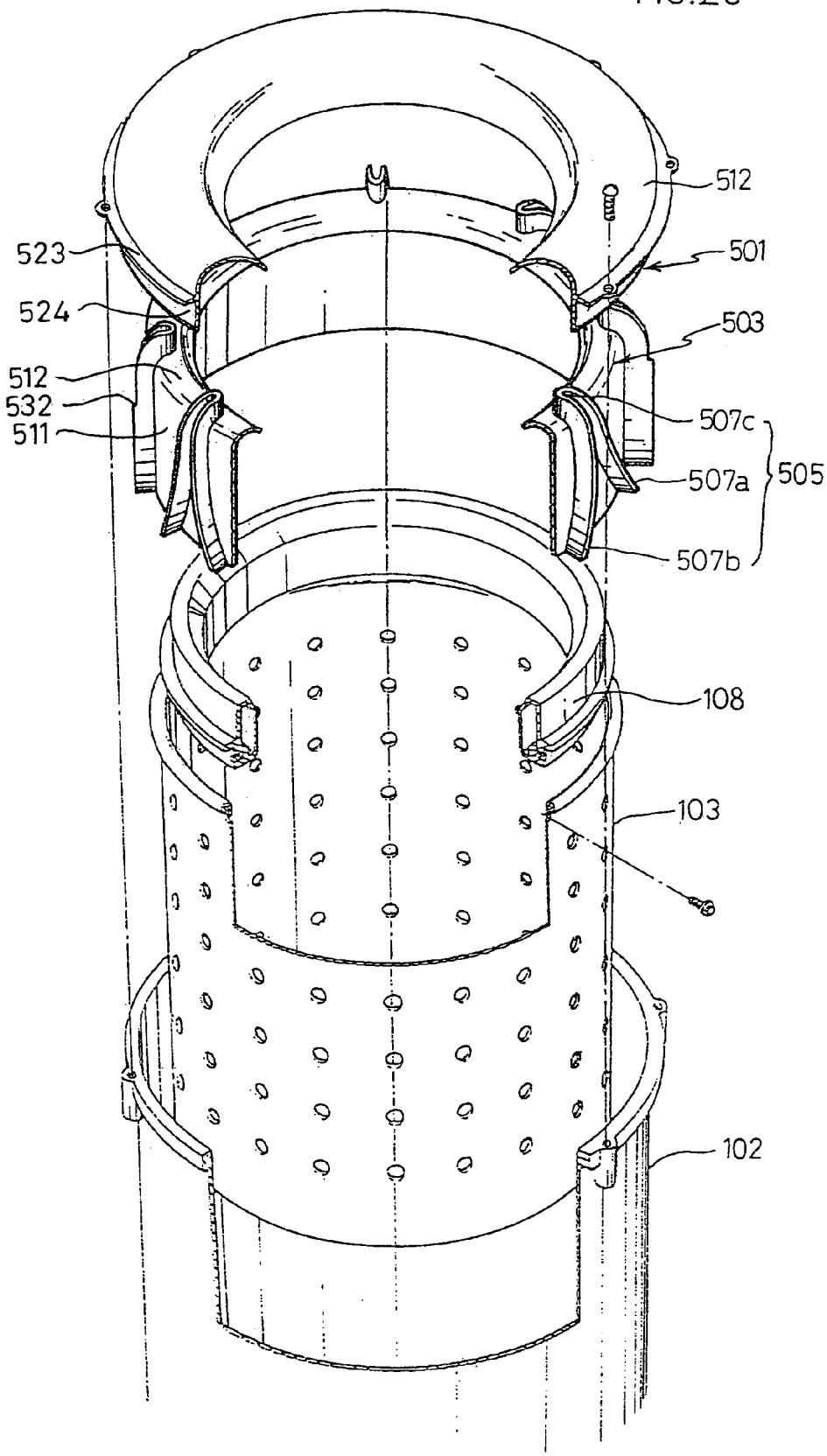
Figure 27:
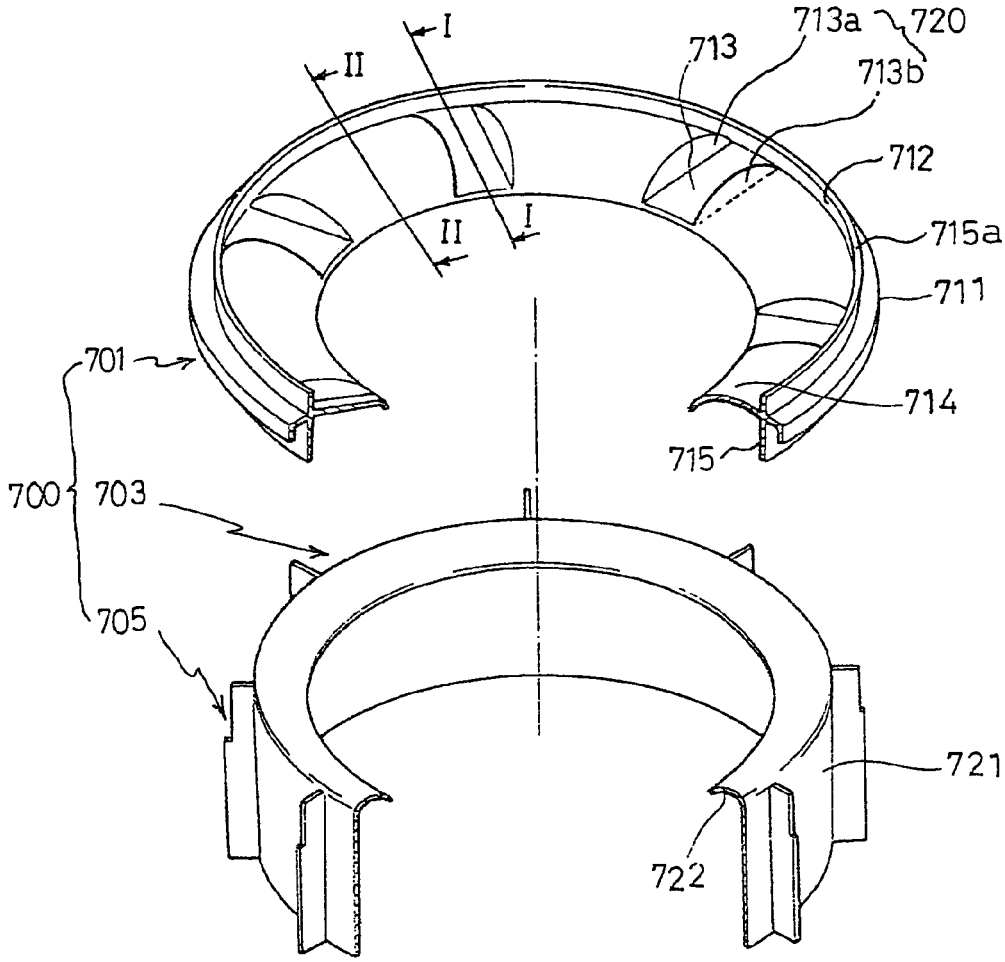
Figure 28:
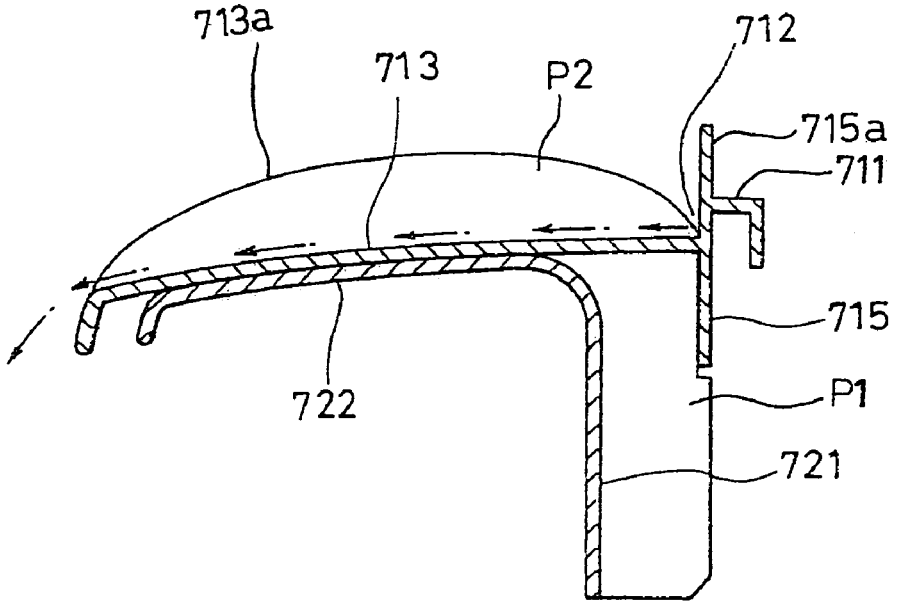
Figure 29:
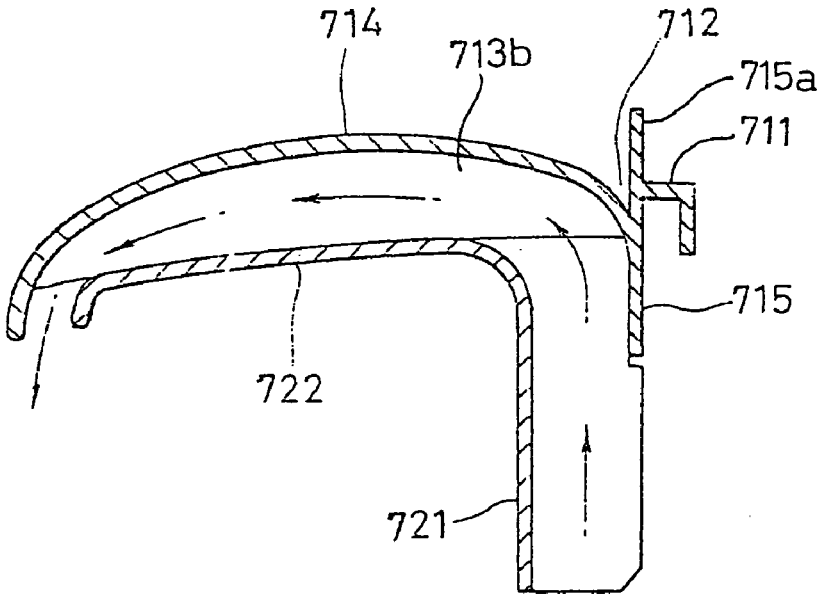
Figure 30:
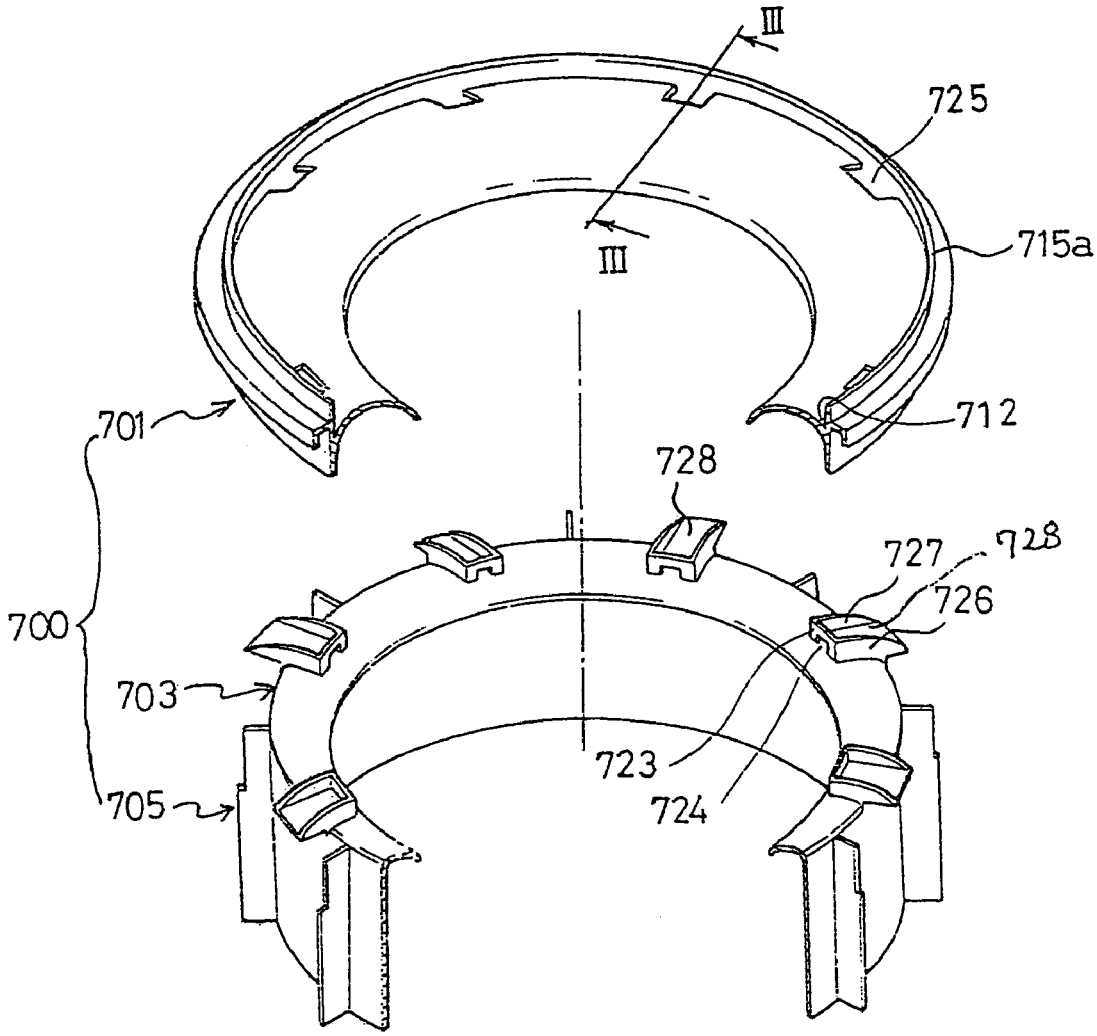
Figure 31:
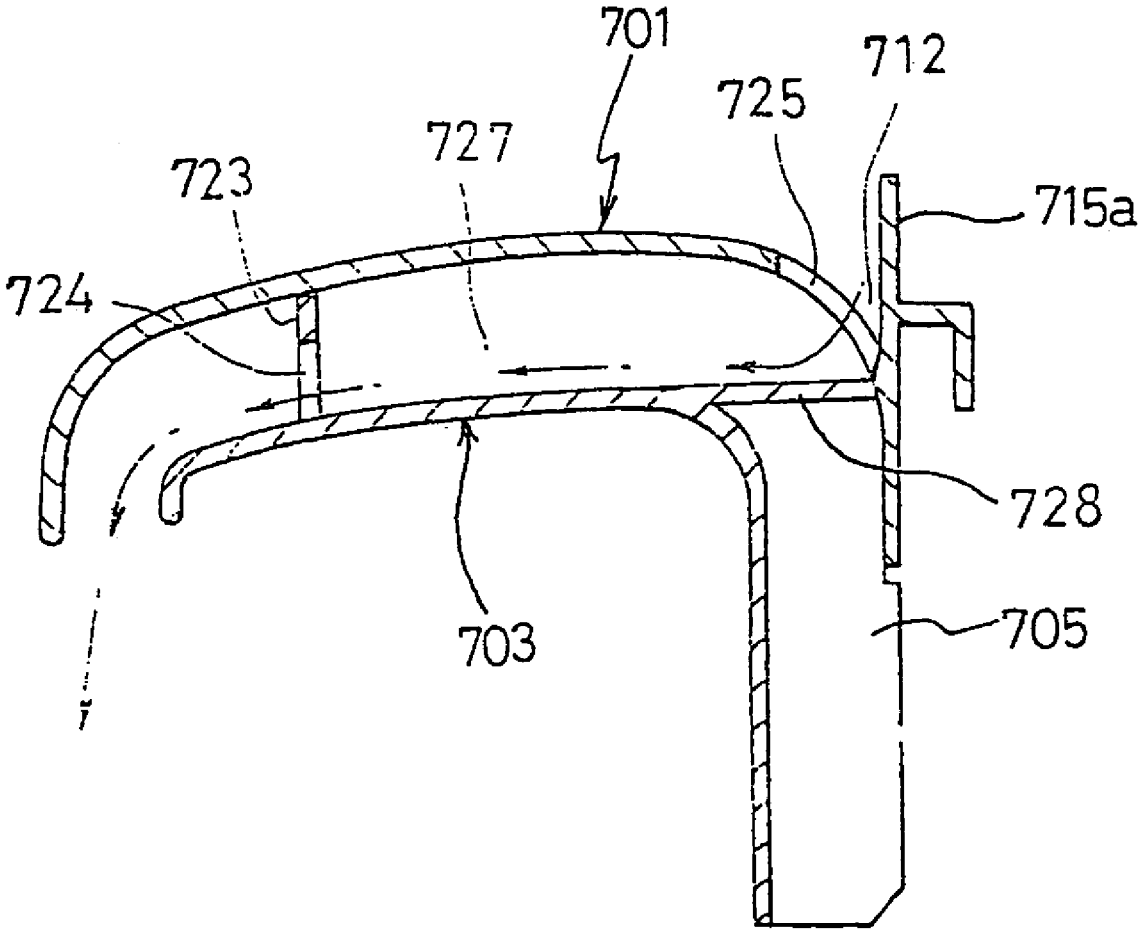
Figure 32:
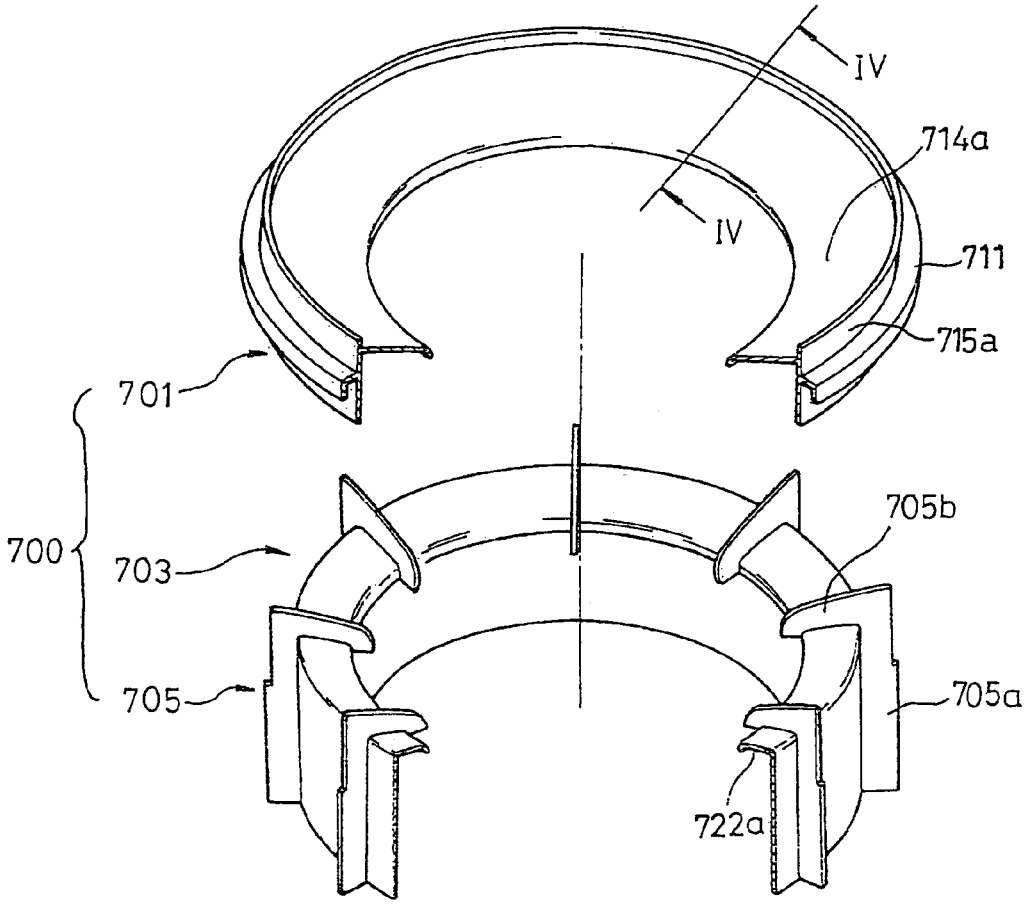
Figure 33:
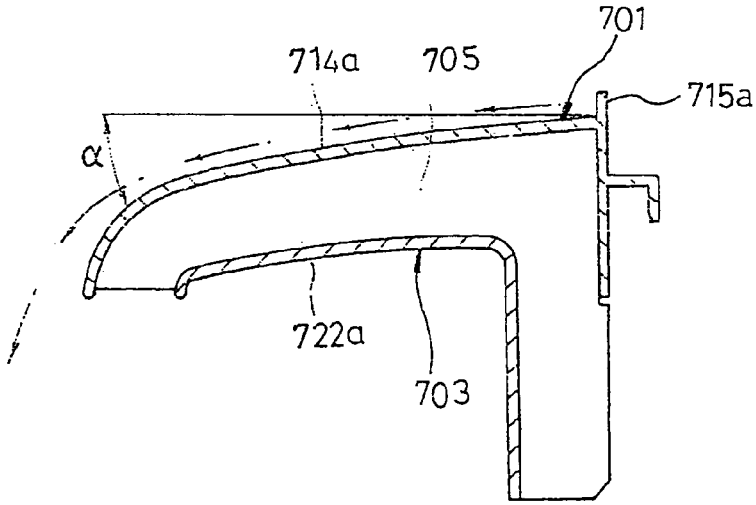
Figure 34:
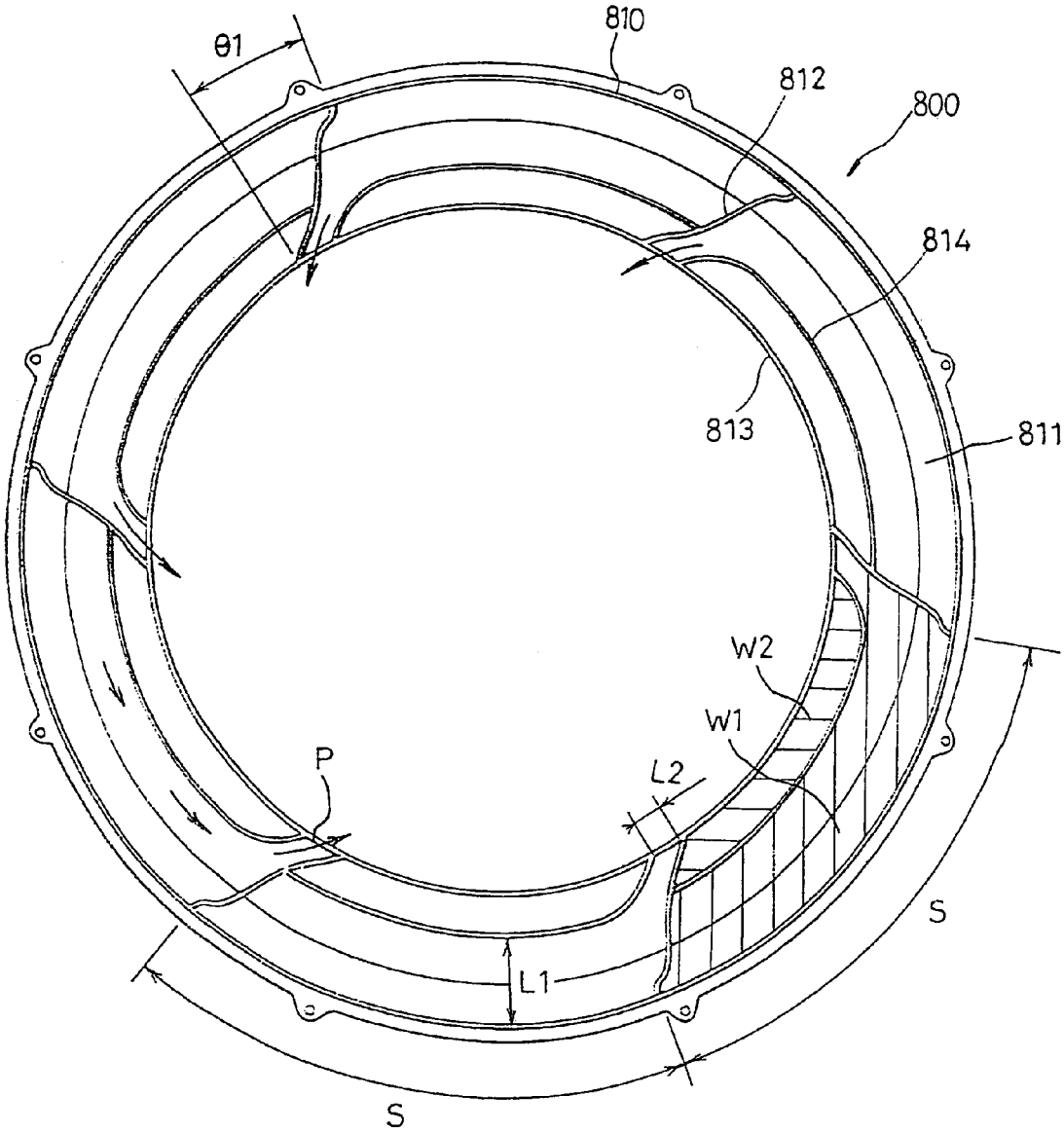
Figure 35:
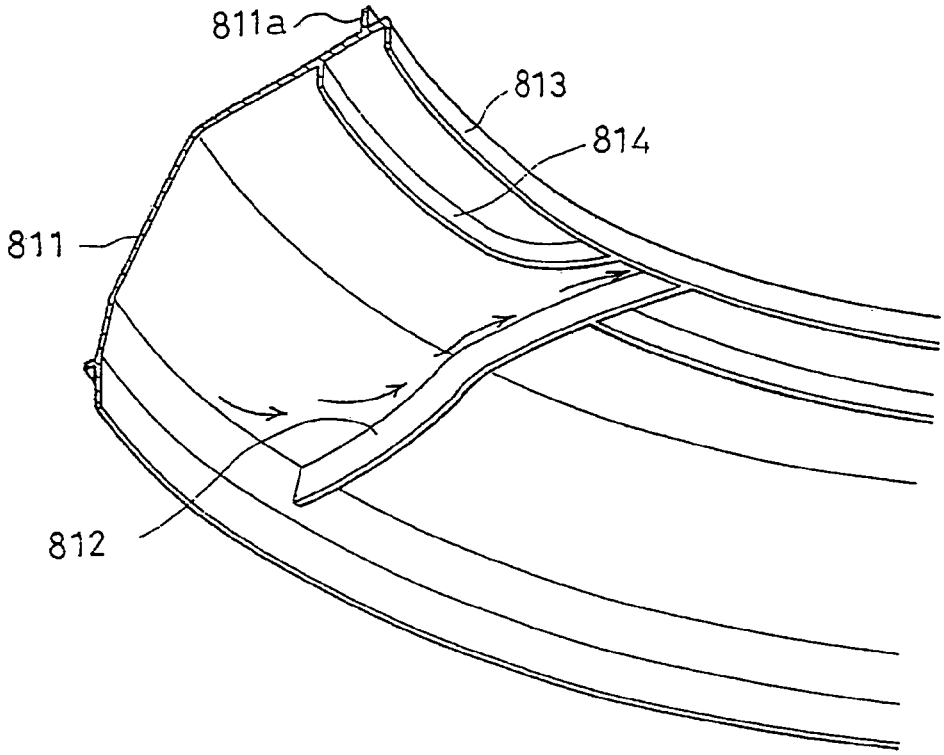
Figure 36:
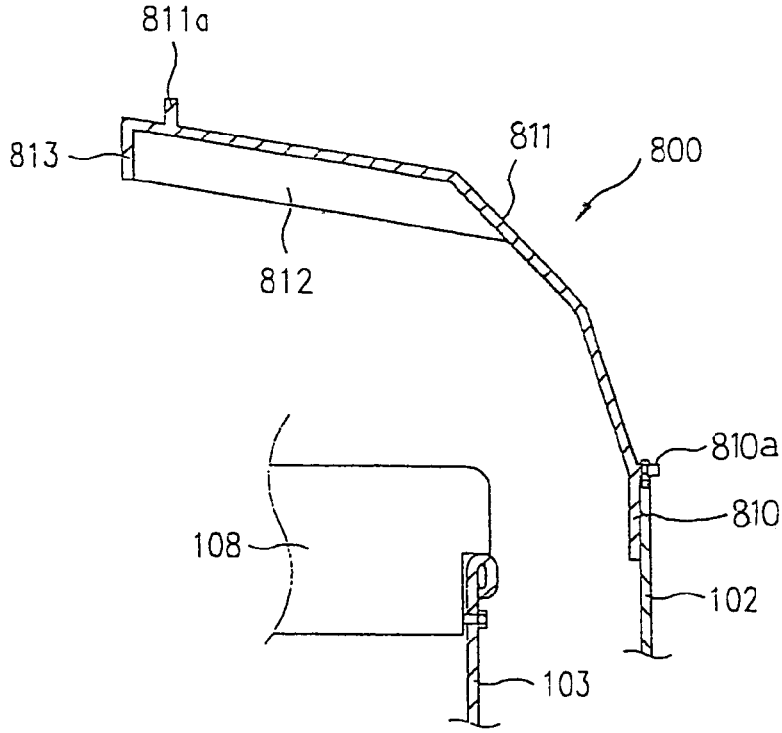
Figure 37A:
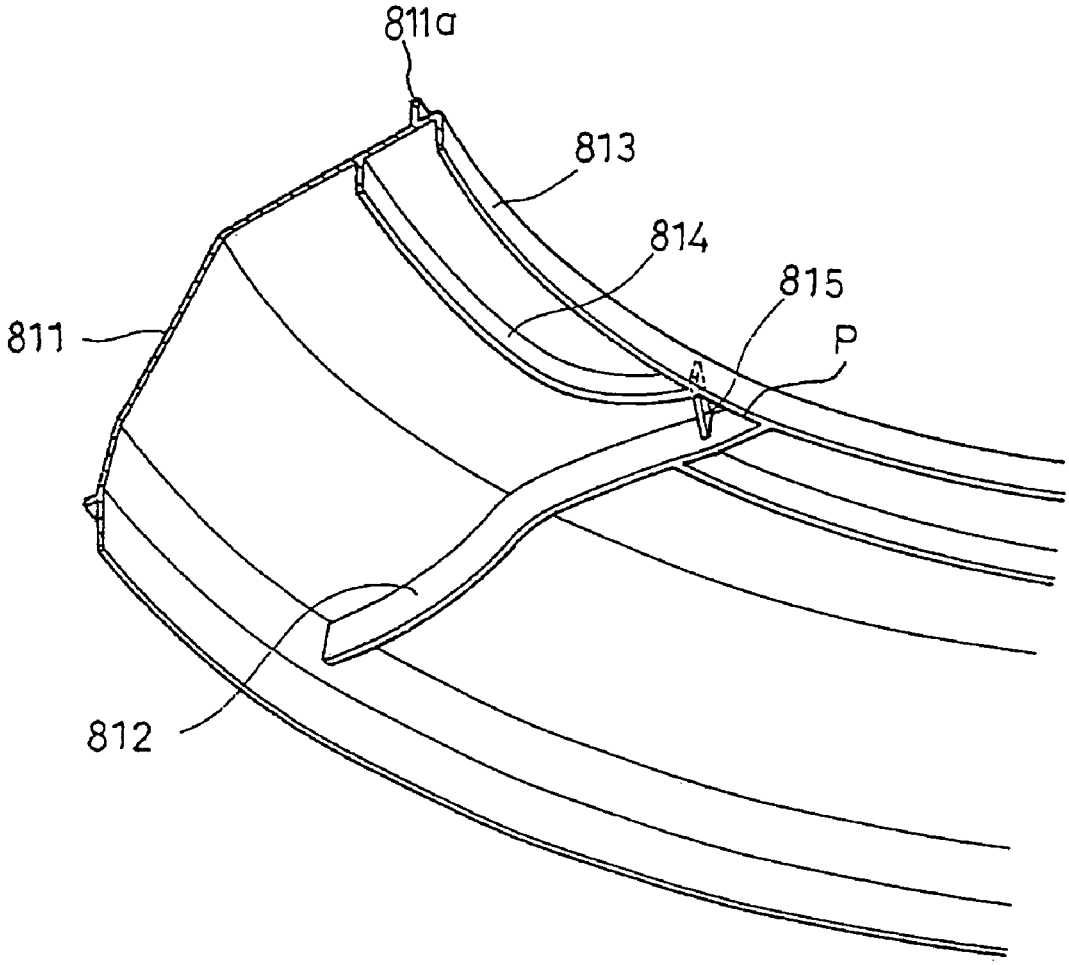
Figure 37B:
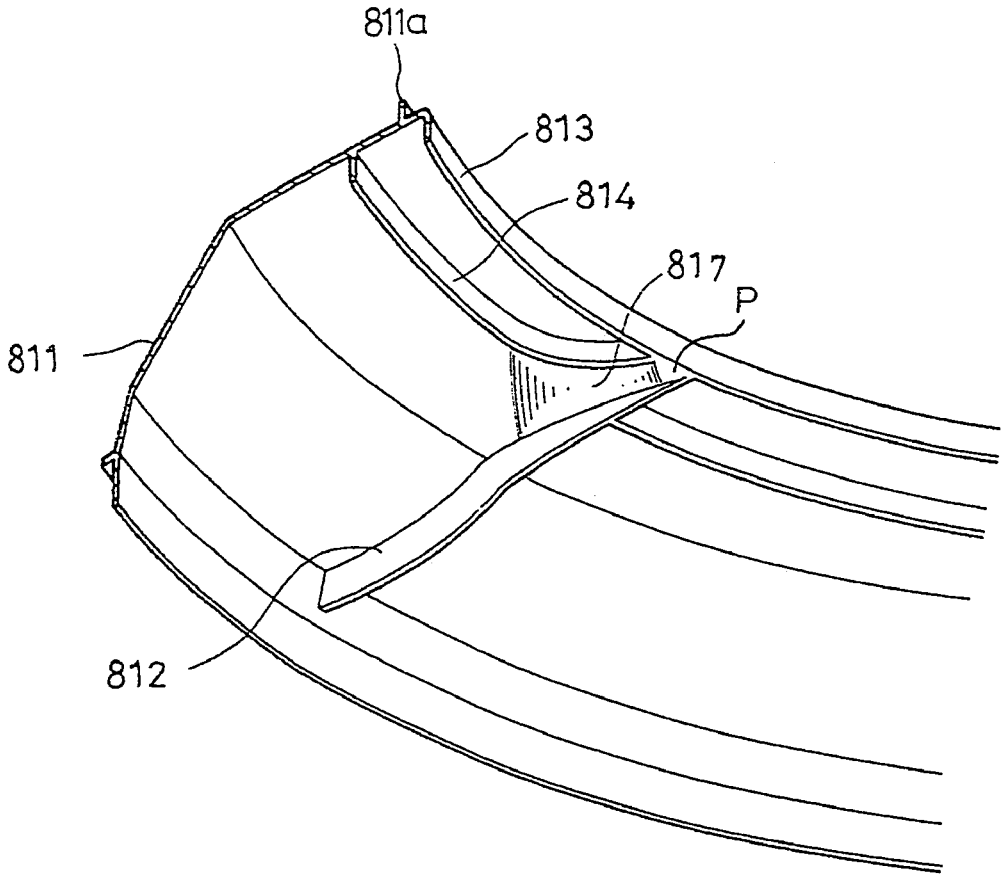
Figure 38:
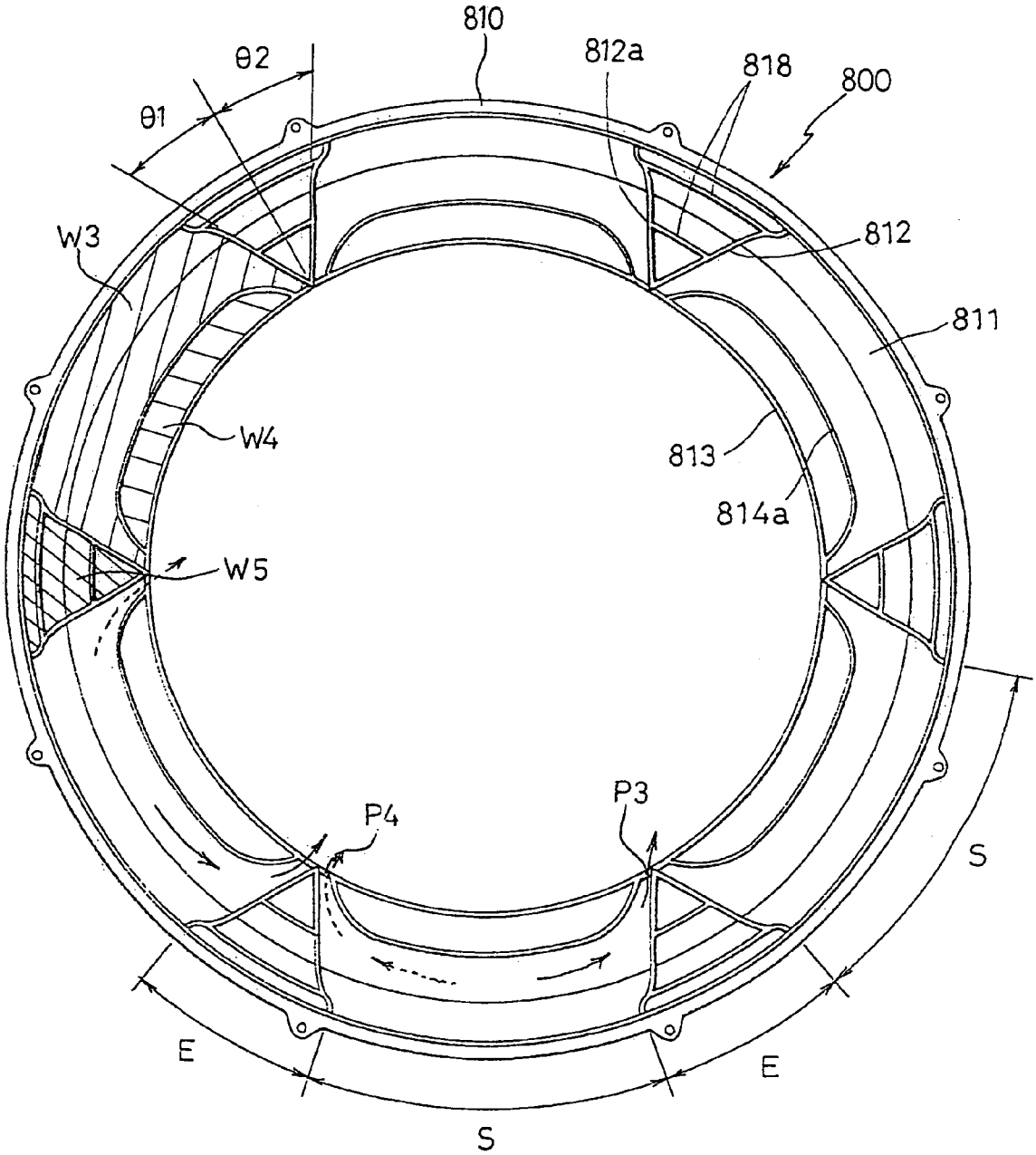
Figure 39:
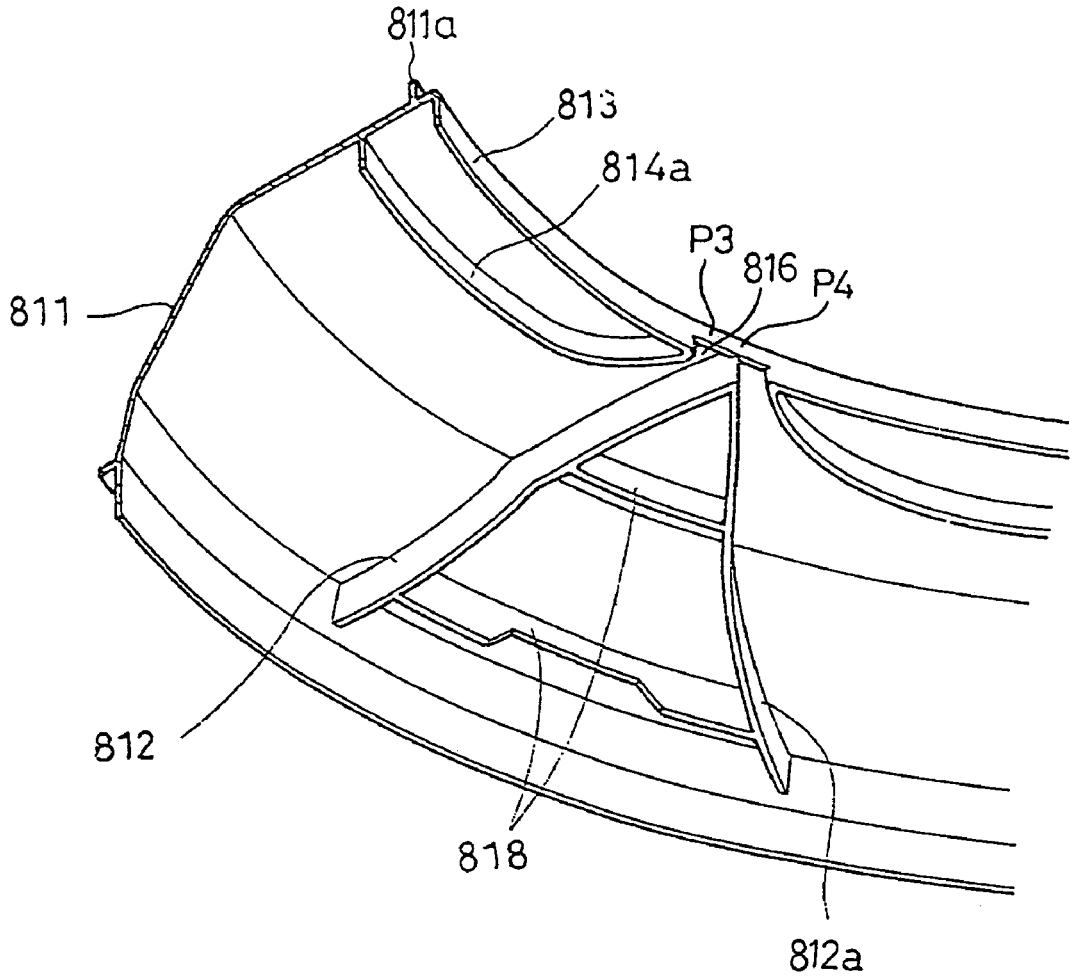
Figure 40:
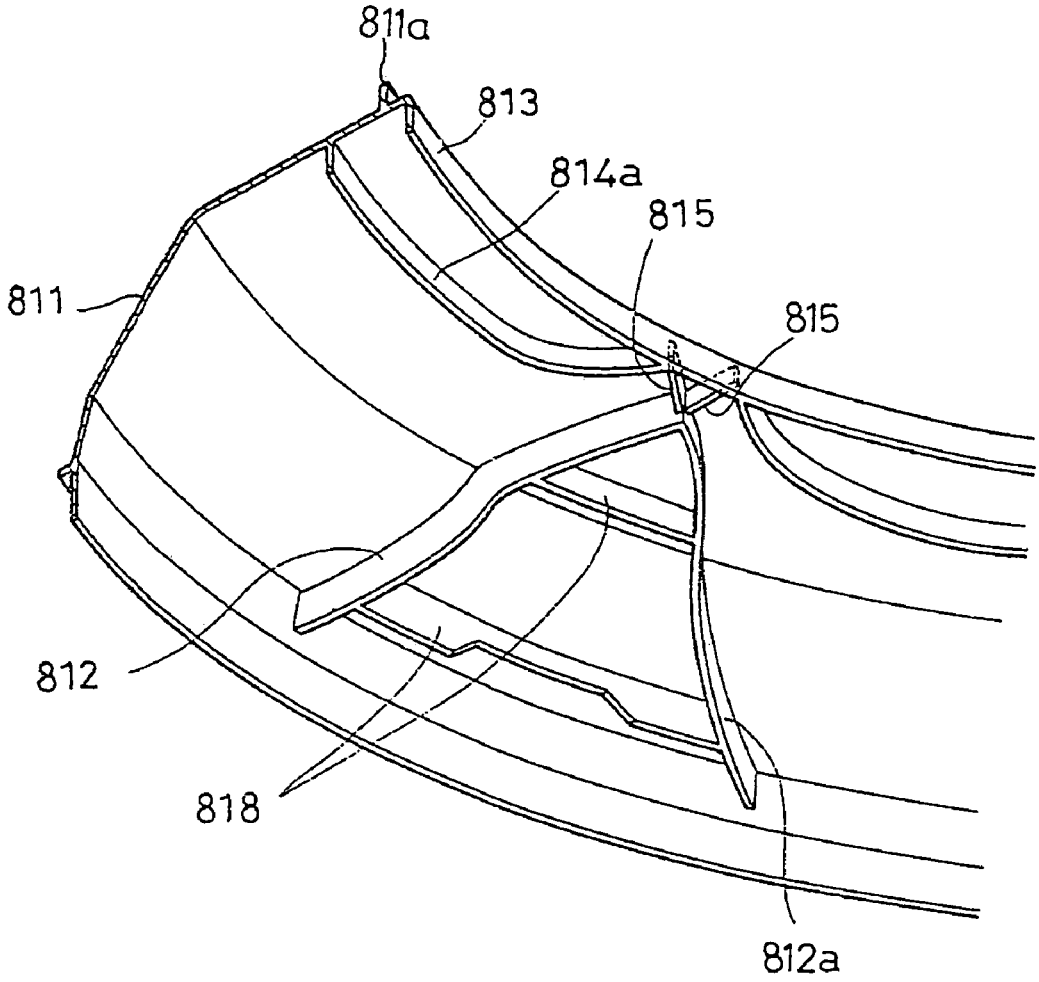
Figure 41:
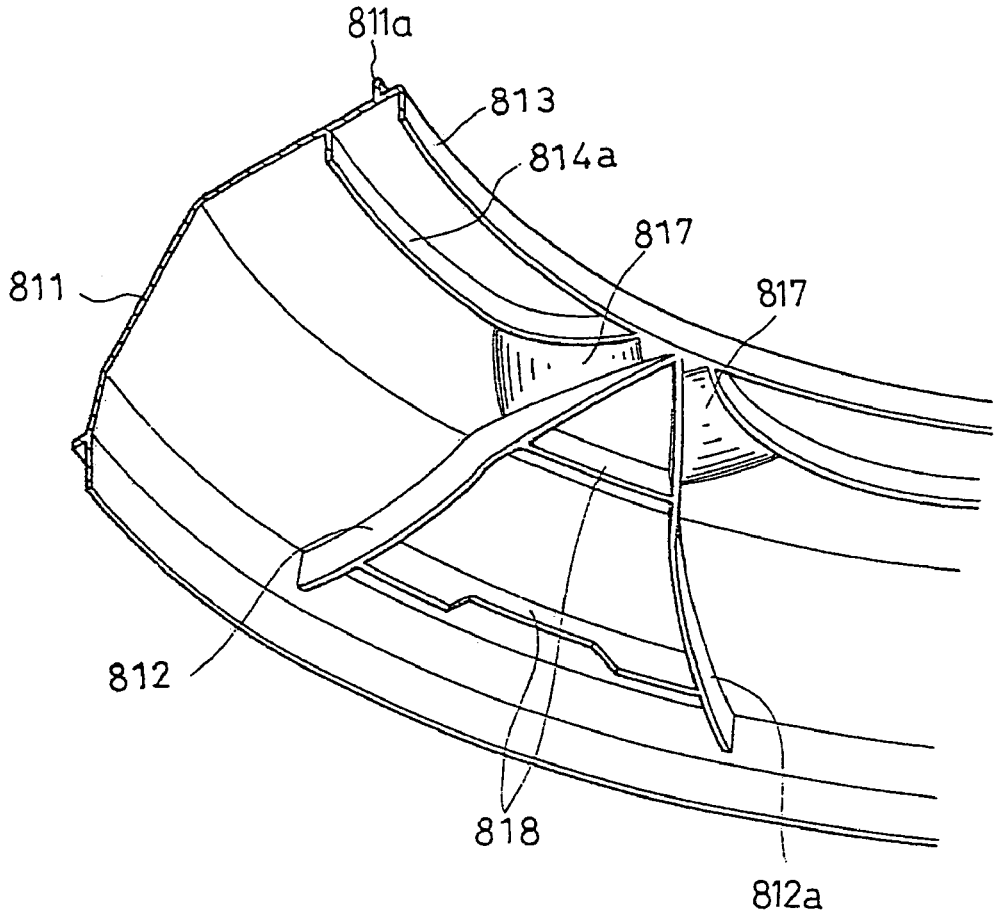

FIGS. 3A~3C illustrate sections of a penetration type washing machine in accordance with a preferred embodiment of the present invention, wherein FIG. 3A illustrates a penetration washing process, FIG. 3B illustrates an agitation washing process, and FIG. 3C illustrates a restoration circulation washing process;

FIGS. 4~6 illustrate sections of a tub cover in accordance with a first preferred embodiment of the present invention;

FIG. 7 illustrates a disassembled perspective view of a tub cover in accordance with a second preferred embodiment of the present invention;

FIG. 8 illustrates a perspective assembly view of the tub cover in FIG. 7 with partial sections of the components;

FIG. 9 illustrates an assembled sectional view of a tub cover, a modified version from FIG. 8;

FIG. 10 illustrates a perspective view of a tub cover in accordance with a third preferred embodiment of the present invention;

FIG. 11 illustrates a section showing the tub cover in FIG. 10 fitted to a washing machine;

FIG. 12 illustrates an operation principle of the tub cover shown in FIG. 10;

FIG. 13 illustrates a perspective view of a tub cover modified from one shown in FIG. 10;

FIG. 14 illustrates a disassembled perspective view of a tub cover in accordance with a fourth preferred embodiment of the present invention;

FIG. 15 illustrates a section showing an assembled view of the tub cover in FIG. 14;

FIG. 16 illustrates a section showing an enlarged part "B" in FIG. 15;

FIG. 17 illustrates a disassembled view of the tub cover shown in FIG. 14;

FIG. 18 illustrates a section showing a modified version of a fastening structure of the tub cover in accordance with a fourth preferred embodiment of the present invention;

FIGS. 19~22 illustrates sections showing different modifications of the tub cover in FIG. 14;

FIG. 23 illustrates a cross section showing another modification of the tub cover in FIG. 14;

FIG. 24 illustrates a disassembled perspective view of a tub cover in accordance with a fifth preferred embodiment of the present invention;

FIG. 25 illustrates a partial cut away perspective view for explaining an operation of the tub cover shown in FIG. 24;

FIG. 26 illustrates a disassembled perspective view showing a modification from the tub cover in FIG. 24;

FIG. 27 illustrates a disassembled perspective view of a tub cover in accordance with a sixth preferred embodiment of the present invention;

FIG. 28 illustrates a section across line I-I in FIG. 27;

FIG. 29 illustrates a section across line II-II in FIG. 27;

FIG. 30 illustrates a disassembled perspective view showing a modification of the tub cover shown in FIG. 27;

FIG. 31 illustrates a section across line III-III in FIG. 30;

FIG. 32 illustrates a disassembled perspective view showing another modification of the tub cover shown in FIG. 27;

FIG. 33 illustrates a section across line IV-IV in FIG. 32;

FIG. 34 illustrates a bottom view of a tub cover in accordance with a seventh preferred embodiment of the present invention;

FIG. 35 illustrates a bottom perspective view of the tub cover shown in FIG. 34;

FIG. 36 illustrates a longitudinal section view of the tub cover shown in FIG. 34;

FIGS. 37A and 37B illustrate bottom perspective views each showing a modification of the tub cover shown in FIG. 34;

FIG. 38 illustrates a bottom view showing a tub cover in accordance with an eighth preferred embodiment of the present invention;

FIG. 39 illustrates a bottom perspective view of the tub cover shown in FIG. 35; and, FIGS. 40 and 41 illustrate bottom perspective views each showing a modification of the tub cover shown in FIG. 38.

DETAILED DESCRIPTION OF PREFERRED EMBODIMENTS

Reference will now be made in detail to the preferred embodiments of the present invention, examples of which are illustrated in the accompanying drawings. A penetration type washing machine, and a method for controlling the same will be explained with reference to FIGS. 3A~3C.

Referring to FIGS. 3A~3C, there is an inner tub 103 having a plurality of washing holes 104 rotatably mounted in an outer tub 102, with a pulsator 105 formed as a unit with the inner tub 103. There is a fluid balancer 108 provided on a top of the inner tub 103 for balancing the inner tub 103 during rotation. And, there is a tub cover 400 on a top of the outer tub 102 for preventing noise, suppressing foam formation, and guiding the washing. There is a motor 107 for generating a rotation power under the outer tub 102 and a drain valve 109. The motor 107 is preferably a variable speed motor, with a rotating shaft thereof being directly coupled to a single driving shaft 106 which rotates the inner tub 103 and the pulsator 105 without introduction of additional power transmission device. The aforementioned penetration type washing machine of the present invention facilitates a penetration washing, an agitation washing, and a restoration circulation washing by varying a rotation speed of the motor 107.

The operation of the aforementioned penetration type washing machine of the present invention will be explained with reference to FIGS. 3A~3C.

The penetration type washing will be explained with reference to FIG. 3A. When the washing machine is put into operation, the motor 107 is rotated in a high speed. Then, the driving shaft 106 connected to the motor 107 is rotated, and the pulsator 105 and the inner tub 103 connected to the driving shaft is also rotated in a high speed. As has been explained in the related art, the penetration washing requires a relative flow speed of the washing water passing through the laundry to be higher than a certain level, and the flow speed should be enough to generate a centrifugal force that can force the washing water to flow from the inner tub to the outer tub and, therefrom to circulate to the inner tub again. When the pulsator 105 and the inner tub 103 is rotated at a high speed, a centrifugal force is generated, to push the laundry in the inner tub 103 to a wall of the inner tub 103, and to push the washing water in the inner tub 103 to the outer tub 102 through the washing holes 104 in the inner tub 103, when the washing water penetrates through between textile fabrics of the laundry, thereby making the penetration washing. And, the washing water pushed out to the outer tub 102 and the washing water present on a bottom surface of the outer tub 102 is pumped upward along a space between the inner tub 103 and the outer tub 102 by the centrifugal force, until the washing water hits the tub cover 400 where the washing water turns a flow direction to flow into the inner tub 103 again. The washing water flowed into the inner tub 103 has a substantially high pressure caused by the centrifugal force coming from the high speed rotation of the inner tub 103. Therefore, the washing water can apply an impact to the laundry by the pressure from the centrifugal force and a gravity of the washing water, to provide a beating effect to the laundry, that improves a washing efficiency.

In the meantime, as has been explained in the related art, in the case when the inner tub rotates only in one direction, the wash difference is happened in which extents of wash differ depending on portions of the laundry because positions of the laundry are always fixed. Therefore, the inner tub is rotated in a reverse direction after the inner tub is rotated in a regular direction for a preset time period. Then, the laundry pushed to wall of the inner tub is gathered to a center of the inner tub when the inner tub changes its direction of rotation from regular direction to reverse direction, and the laundry is pushed onto the wall again as the inner tub is accelerated. Accordingly, as a position of the laundry through which the washing water penetrates is changed, the wash difference can be prevented.

In the meantime, as has been explained, the penetration type washing machine of the present invention permits, not only the penetration type washing, but also agitation type and restoration circulation washings by changing a speed and a direction of rotation of the motor. FIG. 3B illustrates an agitation washing process, referring to which the agitation washing process will be explained.

The agitation washing is available by setting the rotation speed to be below a certain level. That is, if the rotation speed of the motor is set to be comparatively low, the pulsator and the inner tub 103 also rotate at a low speed, at which the centrifugal force is dropped unable to push up the washing water between the inner tub 103 and the outer tub 102, but to keep a certain level. And, the laundry pushed to the wall of the inner tub 103 drops down to the bottom of the inner tub 103 to be submerged in the washing water. Under this state, a water circulation caused by rotation of the inner tub 103 and the pulsator 105 facilitates an agitation washing in a principle identical to a related art pulsator type washing machine. The availability of the penetration washing as well as the agitation washing can provide an excellent washing efficiency.

FIG. 3C illustrates a section showing a restoration circulation washing process, referring to which the restoration circulation process will be explained.

If the inner tub 103 which is rotating at a high speed in a penetration washing is stopped or has a speed dropped, the laundry pushed to the inside wall of the inner tub 103 by an inertia is gathered to a central portion of the inner tub 103 to hit one another. That is, the hitting among the laundry or with the pulsator 105 can make washing. In this instance, for conduction of the restoration circulation washing, though the rotating inner tub 103 may be stopped, the restoration circulation washing is available without a separate restriction. Because the inner tub repeats regular and reverse rotations in the penetration washing, the restoration circulation washing is automatically and continuously made whenever the direction of rotation is changed.

Upon completion of the penetration washing, the agitation washing, and the restoration circulation washing, a dewatering cycle is conducted. And, upon completion of the dewatering cycle, a water re-supply process is conducted to conduct a following rinsing process. Though the penetration type washing machine of the present invention may only carry out the penetration type washing, it is preferable that the penetration type washing machine carry out an appropriate combination of the penetration type washing, an agitation type washing and a restoration circulation washing depending on an extent of contamination and an amount of the laundry. And, as has been explained, one washing cycle or a rinsing cycle may be divided into small intervals for repeating the penetration washing and the agitation washing in the intervals, or different from this, it is also possible that re-water supply is made to conduct the agitation washing after completion of the penetration washing.

Advantages of the penetration type washing machine and a method for controlling the same of the present invention will be explained.

As the penetration type washing machine of the present invention makes the penetration type washing mostly, entangling of, and damage to the laundry is reduced compared to the pulsator type washing machine. The re-supply of the washing water into the inner tub in the penetration type washing facilitates consumption of less washing water, with use of less detergent, and faster washing water supply and drain, that minimizes waste of time in the supply and drain of the washing water. Moreover, the washing water in the outer tub do nothing but interferes the rotation of the inner tub 103 in the pulsator type washing machine because the washing water in the outer tub generates a friction when the inner tub is rotated even though the washing water in the inner tub act an important role as the washing water in the inner tub is brought into contact with the laundry to make washing. Therefore, in order to make a smooth rotation, it is important for the inner tub to make a less contact with the washing water in the outer tub as far as possible. By the way, the penetration type washing machine of the present invention has a small amount (approx. 50%) of washing water supplied to the inner tub and the outer tub, and the washing water is pumped into the inner tub again in conducting the washing. That is, as the outer tub has less amount of washing water, rotation of the inner tub is smoother. Different from the related art penetration type washing machine, the penetration type washing machine has a simple system as no separate pumping device are required, and facilitates a satisfactory washing efficiency while preventing entangling of, or damage to the laundry by an appropriate combination of the penetration washing, the agitation washing and the restoration circulation washing. The penetration type washing machine of the present invention has the washing water in the inner tub 103 pumped up to the top portion thereof through a space between the inner tub 103 and the outer tub 102 at a substantially high pressure, to be re-circulated into the inner tub 103. Consequently, the high pressure of the washing water pumped upward may cause leakage if the related art tub cover is used as it was. Though this leakage may be prevented by providing gasket on a top surface of the outer tub 102, accurate fitting of the gasket to a large diametered outer tub 102 is not practicable. Therefore, it is preferable that the tub cover structure of the penetration type washing machine is changed, appropriately. The tub cover of the present invention will be explained.

A first embodiment tub cover of the present invention will be explained with reference to FIGS. 4~6. The first embodiment tub cover is substantially identical to the one of the related art except that a leakage prevention means is additionally provided in the first embodiment tub cover.

That is, similar to the related art tub cover, the first embodiment tub cover 400 includes an upper surface portion 411, a tight fit portion 413, and a fastening portion 412. However, different from the related art, the fastening portion 412 has a downward projection at an approx. center thereof in parallel to the tight fit portion 413, and there is a slot on a top portion of the outer tub 102 for insertion of the projection 415 thereto. And, there is a sealing member 417 in a space formed between the tight fit portion 413 and the projection 415 for prevention of leakage.

And, referring to FIG. 5, a length of the projection 415 may be formed shorter, for providing the sealing member 417 in a space formed below the projection 415.

And, as shown in FIG. 6, the sealing member may be disposed on a top end of the outer tub 102. In detail, as the sealing member 417 is fitted to the top end of the outer tub 102, a support 102*b* is projected in an outward radial direction of the outer tub 102 from a portion below the top end portion 102*a* of the outer tub 102. And, a horizontal portion 441 is formed at an outer circumference of the upper surface portion 411 of the tub cover 400, with an end of the horizontal portion 441 bent downward, to form a tight fit portion 413 which fit to an inside surface of the support 102*b* in the outer tub 102, without providing the fastening portion. And, in order to make the assembly easy, the sealing member 417 is preferably attached to the horizontal portion 441 of the tub cover with adhesive 452. And, it is preferable that a position the support 102*b* in the outer tub 102 is projected is to be below the top end of the outer tub 102, to provide a space between the top end 102*a* of the outer tub 102 and the support 102*b*. Because if leakage of the washing water is happened despite of the sealing member 417, the leakage of washing water may be collected in the space. The washing water collected in the space is drained using overflow hose(not shown) connected to an air vent hose. The first embodiment tub cover can prevent leakage of the washing water even if the washing water is pumped to the tub cover 400 at a high pressure by means of the sealing member 417. And, as the fitting of the tub cover 400 to the outer tub 102 only requires insertion of the projection 415 at the tub cover to the slot in the outer tub 102, the assembly is simple. And, as the slot serves as a guide, for accurate fitting of the tub cover 400 to the outer tub 102, preventing vibration during operation of the washing machine.

In the meantime, even if the first tub cover 400 can prevent leakage of the washing water, neither spray of the washing water caused by hitting the tub cover can be prevented, nor an exact guide of the washing water into the inner tub 103 is possible. Therefore, the following second to seventh embodiments tub covers of the present invention will provide improved tub covers. The second embodiment tub cover will be explained with reference to FIGS. 7 and 8.

The second embodiment tub cover 200 includes an upper tub cover 201 fastened to the outer tub 102, and a lower tub cover 203 mounted under the upper tub cover 201 with a space therefrom, wherein there are washing water guide passages P1 and P2 formed between the upper and lower tub covers. The upper tub cover 201 has a substantially annular form of an upper surface portion 211, a tight fit portion 214 projected from an outer end of the upper surface portion 211 vertically for tight fit to an inside wall of the outer tub 102, and a fastening portion 215 extended from the tight fit portion 214 in a horizontal direction for fastening to a top end of the outer tub, forming an "L" section, substantially. The lower tub cover 203 has an upper surface portion 221, and a vertical portion 225 projected downward from an outer end of the upper surface portion 221, with a plurality of reinforcing brackets 224 connected between the upper surface portion and the vertical portion. There are a plurality of height adjustment members 222 formed at fixed intervals. In order to couple the upper tub cover 201 to the lower tub cover 203, it is preferable that the height adjustment members 222 have a female thread 223, and the upper surface portion 221 of the upper tub cover 201 has a plurality of fastening holes 212 formed at positions corresponding to the height adjustment members 222.

Referring to FIG. 8, a fastened state will be explained. The upper tub cover 201 and the lower tub cover 203 are fastened with screws 213, and the upper tub cover 203 is fastened to a top end of the outer tub 102 with screws. Therefore, as shown in FIG. 8, the washing water pumped to the tub cover 200 is guided by the guide passage P1 and P2 between the upper tub cover and the lower tub cover, to guide the washing water into the inner tub 103 smoothly, which improves a pumping efficiency. And, the spray of the washing water can be prevented. And, a pressure of the washing water sprayed to the inner tub 103 from the tub cover 200 is adjustable by adjusting a space S between the upper tub cover and the lower tub cover, i.e., a height of the height adjustment member 222. By the way, there is a possible leakage through a gap between the fastening holes in the upper tub cover 201 and the screws in FIG. 8. Therefore, as shown in FIG. 9, it is preferable that height adjustment members 222*a* are formed on the upper tub cover 201, and pass-through holes are formed in the lower tub cover 203. Because the washing water flowing from the tub cover 200 to the inner tub 103 advances in a tangential direction of an inside diameter of the inner tub 103 by the centrifugal force.

A tub cover having modified such drawback is the third embodiment tub cover, which will be explained with reference to FIGS. 10~11.

The third embodiment tub cover 300 includes an upper surface portion 301 and a tight fit portion 303, and there are a plurality of deflectors 302 on an underside of the upper surface portion 301 for deflecting a flow direction of the washing water. The deflector 302 is fitted in a radial direction for deflecting the washing water advancing in a tangential direction to a center direction. There are a plurality of deflectors fitted as fixed intervals to divide the flow paths. As shown in FIG. 12, this structure permits the washing water pumped and flowed into the tub cover 300 hits the deflectors 302, to change a direction of flow toward, not the tangential direction, but the center direction, substantially. And, as shown in FIG. 13, there may be a guide rib 305 on the deflector 302 for reducing a friction of the washing water. And, a plate drop preventor 305 may preferably be fitted at a bottom of the deflector 302 for preventing drop of the washing water, flowing into the tub cover, into a space between the inner tub 103 and the outer tub 102 by gravity, but to be supplied to the inner tub 103. Of course, the drop preventor 305 may be provided with a larger area or the lower tub cover of the second embodiment may be provided. And, the height adjustment members 222 and 222*a* in the second embodiment may be formed to have forms of the deflectors 302, for combined use of the height adjustment members 222 and 222*a* as the deflectors.

Because outlets of the washing water passages P2 are substantially horizontal in the first to third embodiments tub covers, the washing water flows out substantially in the horizontal direction. Opposite to this, the following fourth to seventh embodiment tub covers are provided with an adjustable spray angle, with a convenience of assembly.

The fourth embodiment tub cover will be explained with reference to FIGS. 14~16.

Alike the second embodiment tub cover, the fourth embodiment tub cover also include an upper tub cover 501 and a lower tub cover 503 for forming a washing water passage. The upper tub cover 501 has an upper surface portion 521, a tight fit portion 522, and a fastening portion 523, and the lower tub cover 503 also has an upper surface portion 512 and a vertical portion 511, except that there are a plurality of guide members 505 fitted at fixed intervals provided between the upper tub cover and the lower tub cover for combined use as the height adjustment members and the deflectors in the aforementioned embodiments. The guide member 505 is preferably formed extended from inlet to outlet of the flow passage to cover the entire washing water passage. In this embodiment, the horizontal passage P2 is formed to direct a lower portion of the inner tub 103, and the upper tub cover 501 and the lower tub cover 503 are provided with downward curvatures to provide a stream lined horizontal passage P2 for minimize a friction. The lower tub cover 503 is mounted spaced from the fluid balancer 108 by a preset distance T1, with a chamfer 507 in the fluid balancer 108 to suit to a contour of the passage P2. Because this configuration can prevent bumping between the fluid balancer 108 and the tub cover 500. And, in order to prevent bumping between the fluid balancer 504 and the outer tub 102 and 502, a second gap T2 formed between the fluid balancer 504 and the outer tub 102 and 502 may be further provided. The distance T1 is preferably identical to the gap T2 between the fluid balancer 108 and the outer tub 102, substantially.

A fastening structure of the fourth embodiment tub cover of the present invention will be explained with reference to FIG. 17.

Figure 20:
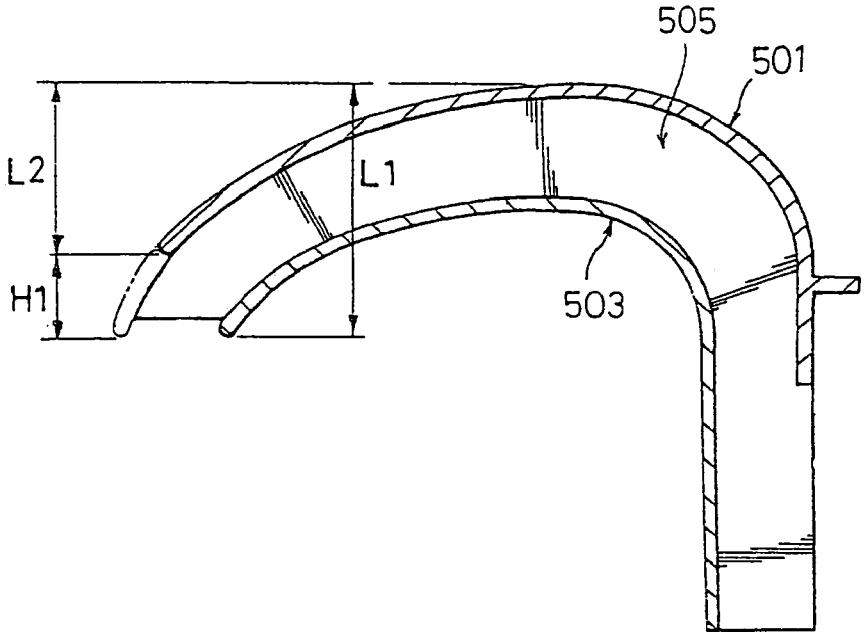
Figure 21:
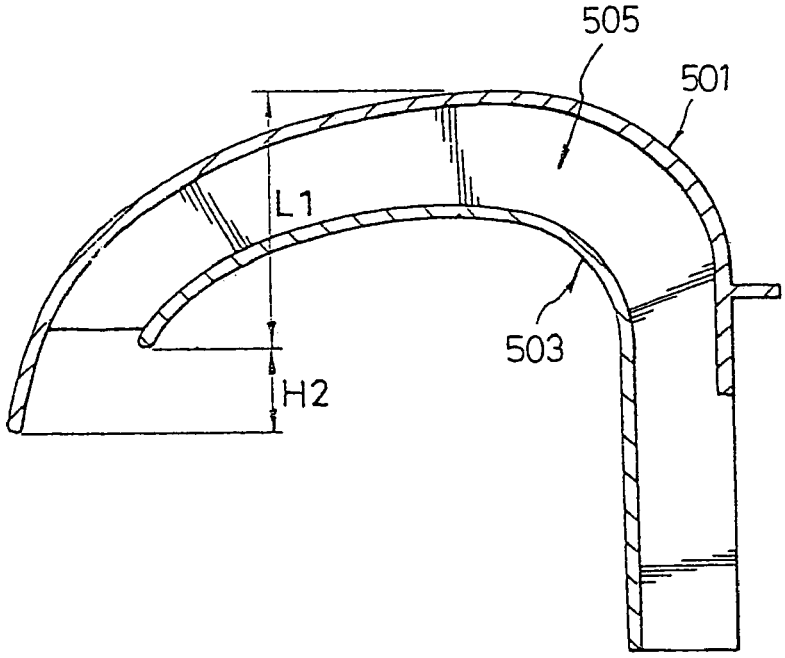
Figure 22:
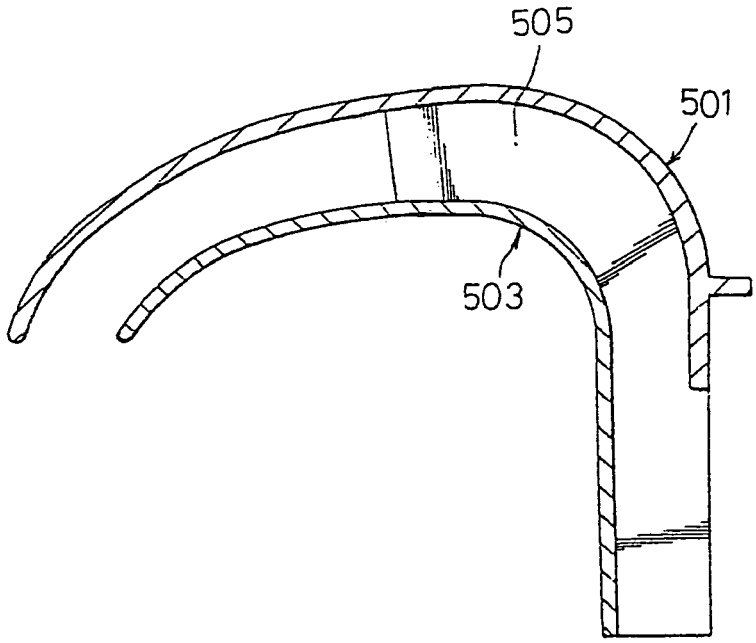

Alike the previous embodiment, if the upper tub cover, the guide member and the lower tub cover are fastened with screws, the washing water may leak. Therefore, it is preferable that the upper tub cover 501, the guide members 505 and the lower tub cover 503 are fabricated separately and jointed them together by means of welding and the like. Of course, it is possible that either the upper tub cover 501 and the guide members 505 may be fabricated as a unit, to which the lower tub cover 503 is welded, or the lower tub cover 503 and the guide members 505 may be fabricated as a unit, to which the upper tub cover 501 is welded. In this instance, for the sake of convenience of assembly and preventing projection of the upper tub cover 501 to an outward radial direction, there is a stepped portion 532 at one side of the lower tub cover 503 for catching a bottom end of the upper tub cover 501. As shown in FIG. 18, fastening with screws is also possible, particularly, fastening the lower tub cover 503 to the guide member 505 with screws 534 is effective in view of leakage prevention. Similar to the previous embodiments, this embodiment tub cover serves for a smooth guidance of the washing water, prevention of spray, and prevention of leakage. In addition to this, this embodiment tub cover can further improve a pumping performance and washing performance because the washing water passage is streamlined with a preset curvature, which minimizes a loss caused by friction to guide the washing water into a lower portion of the inner tub 103 effectively. By the way, in this embodiment, fore ends of the upper tub cover 501 and the lower tub cover 503, i.e., a width W of an outlet of the washing water may be adjusted for adjusting the pressure of the washing water. That is, the more the width W of the outlet of the washing water is reduced, the higher the pressure of the washing water. The width W may preferably be adjusted by decreasing or increasing a fore end of the upper tub cover 501 by an angle θ toward a fore end direction of the lower tub cover 503. And, as shown in FIGS. 20 and 21, the fore end of the upper tub cover 501 may be extended or shortened with respect to the fore end of the lower tub cover 503, for adjusting an angle of spray of the washing water. That is, if the fore end of the upper tub cover is shortened by a distance H1 with respect to the fore end of the lower tub cover 503, the washing water is sprayed upward, and extended by a distance H2, sprayed downward. In conclusion, this embodiment allows an appropriate adjustment of the spray pressure and the spray angle. And, as shown in FIG. 23, a radius R1 formed by the fore end of the upper tub cover 501 and a radius R2 formed by the fore end of the lower tub cover 503 may preferably be made different, to improve a washing water supply efficiency.

In the meantime, as the guide members 505 are not curved, the washing water is adapted to hit the guide member 505 as a right angle, to cause a friction and a consequential reduction of a pumping efficiency. And, the abrupt change of the flow direction of the washing water causes noise coming from impact. And, because the third embodiment tub cover has the deflectors fitted perpendicular to the washing water flow, a portion of the washing water hit onto the deflector turns a flow direction, not to the inner tub, but backwardly opposite to the flow direction of the washing water due to a reaction force. And, a vortex may be occurred in a space formed by an outer circumference of the deflector and the tight fit portion. Those are causes of dropping the pumping efficiency. Accordingly, the following embodiment is a modification for improving such problems.

The fifth embodiment tub cover is the one in which those disadvantages are improved, which will be explained with reference to FIG. 24.

The guide member 505 of this embodiment is formed to have a curvature, for guiding the washing water smoothly with a minimum friction at the guide member 505. As the inner tub 103 rotates in regular and reverse directions, it is preferable that regular direction guide members 505*a* and reverse direction guide members 505*b* are provided, respectively. Because others are the same with the fourth embodiment, the explanation will be omitted. According to this, as shown in FIG. 25, since the washing water pumped by high speed rotation of the inner tub 103 is supplied to the inner tub 103 smoothly with a minimum friction, the pumping efficiency can be improved. However, as shown in FIG. 24, if the regular direction guide members 505*a* and the reverse direction guide members 505*b* are integrated, a fore end 505*c* has no curvature, which has a great friction. Therefore, the fore end 505 also need to have a curvature, preferably. To do this, as shown in FIG. 26, the regular direction guide members 505*a* and the reverse direction guide members 505*b* are preferably provided with curvatures throughout entire lengths, with the fore ends thereof connected with a curved portion 507*c*. Thus, since the washing water pumped during a regular direction rotation of the inner tub 103 is guided by the regular direction guide member 507*a*, with a reduced friction, and the washing water pumped during a reverse direction rotation of the inner tub 103 is guided by the reverse direction guide member 507*b*, with a reduced friction, the curved members 507*a* and 507*b* can improve the pumping efficiency.

In the meantime, even though the aforementioned tub covers of the present invention can prevent spray of the washing water effectively, once sprayed, the sprayed washing water flows to outside of the outer tub 102. Therefore, the following sixth embodiment tub cover is provided for an effective prevention of spray to outside of the outer tub 102. The sixth embodiment tub cover will be explained with reference to FIG. 27.

Similar to the fourth and fifth embodiment tub covers, the sixth embodiment tub cover 700 includes an upper tub cover 701 and a lower tub cover 703 each having a curvature, and a guide members 705. And, the upper tub cover 701 has an upper surface portion 714, a tight fit portion 715 and a fastening portion 711. The lower tub cover 703 also has an upper surface portion 722 and a vertical portion 721. However, in this embodiment, the tight fit portion 715 of the upper tub cover 701 is projected upward to form a projection 715*a*, to form a recess 712 between an outer circumference and the projection 715*a*, to collect the sprayed washing water. Then, the washing water collected in the recess 712 is drained into the inner tub 103 by washing water drain means 720. The washing water drain means 720 is sloped flow passages 713 recessed in the upper surface of the upper tub cover at fixed intervals, with walls 713*a* and 713*b* on both sides of the passage 713. The sloped flow passage 713 is sloped inward downwardly.

In this embodiment, the guide member 705 may only be provided on the vertical flow passage 705, because the walls 713*a* and 713*b* of the sloped flow passages 713 act as the guide members in the horizontal flow passage P2. Accordingly, as shown in FIG. 28, the washing water sprayed and collected in the recess 712 of the upper tub cover 701 flows into the inner tub 103 along the sloped flow passage 713. And, as shown in FIG. 29, the pumped washing water flows to the inner tub 103 through the flow passages formed between the upper tub cover 701 and the lower tub cover 703, when the walls 713*a* and 713*b* divide the passage. The walls 713*a* and 713*b* are formed with curvatures for guiding the washing water with a reduced friction in correspondence to the regular and reverse rotation.

The washing water drain means may be as shown in FIGS. 30 and 31. That is, a plurality of drain holes 725 are formed in the recess of the upper tub cover 701 at fixed intervals. And, guide members for guiding the washing water into the inner tub 103 from the drain holes 725 are preferably provided in the lower tub cover 703. Because if there are no guide members, the washing water drained through the drain holes will flow the space between the inner tub 103 and the outer tub 102 again, to resist against the circulation of the washing water as the lower tub cover 703 also has a curvature. The guide member has one pair of walls 726 and 727 formed vertical to the upper surface of the lower tub cover 703 at a width slightly greater than the width of the discharge hole 725 and a sloped passage 728 connecting the walls 726 and 727 and sloped downwardly in an inner radial direction. The walls 726 and 727 also serve as the height adjustment member. And, a front portion 723 with a supply hole 724 may be provided in front of the walls 726 and 727.

The operation of this embodiment tub cover will be explained. The pumped washing water is collected in the recess 712 of the upper tub cover 701. The washing water collected in the recess 702 flows into the lower tub cover 703 through the drain holes 725, and into the inner tub 103 along the sloped passage 728. Thus, spray of the washing water out of the outer tub 102 can be prevented. In the meantime, as shown in FIGS. 32 and 33, it is, of course, possible that the upper surface of the upper tub cover 701 is provided with a slope α without the washing water drain means, for natural flow of the washing water sprayed to the upper tub cover 701 into the inner tub 103 along the upper surface of the upper tub cover 701. In this instance, it is preferable that the guide member 705 is extended to the horizontal passage, i.e., to form a vertical portion 705*a* and a horizontal portion 705*b*.

The second to sixth embodiment tub covers have complicated structures and high cost because the tub covers include the upper tub covers, the lower tub covers and guide members, which are comparatively many components that is difficulty in assembly. Therefore, the following seventh and eighth embodiment tub covers provide tub covers which have simple structures but have effects the same with the aforementioned embodiments. Different from the foregoing second to sixth tub covers, the following embodiment tub covers have one single tub cover(corresponding to an upper tub cover in the related art). And, different from the first embodiment tub cover, these embodiment tub covers are provided with means on a bottom surface of the tub cover for guiding the washing water into the inner tub. The pumped washing water can be guided into the inner tub only using a tub cover corresponding to an upper tub cover without using a lower tub cover owing to the following reason. The penetration washing requires fast running of the motor for pumping the washing water. That is, in the penetration washing, the washing water should be pumped upwardly to move upward to overcome a gravity of the washing water itself Therefore, as the washing water pumped toward the tub cover does not fall down even if the lower tub cover is used substantially, formation of the washing water passage is possible even if no lower tub cover is used. And, in the case of agitating washing, since the washing water is not circulated and the tub cover only serves for prevention of noise, and foam reduction, the lower tub cover may be dispensed with, too. The seventh embodiment tub cover will be explained in detail with reference to FIGS. 34 to 36.

The seventh embodiment tub cover 800 includes a tight fit portion 810 for tight fit on an inside surface of a top end of the outer tub, an upper surface portion 811 extended upwardly from the tight fit portion 810 at an angle for serving as a guide for the washing water, and a fastening portion 810*a* projected from the tight fit portion 810 in a horizontal direction for being fastened to the outer tub with screws. The upper surface portion 811 may preferably have a curvature, rather than at a right angle to the tight fit portion 810 for reducing friction with the washing water. And, there is a vertical deflector 813 formed downwardly at a fore end of the upper surface portion 811 for downward guide of the washing water to a lower portion of the inner tub, and preferably there is a vertical protector 811 a on an outer circumference of the upper surface portion 811 for protecting the spray of the washing water to outside of the outer tub. There are a plurality of main deflectors 812 formed on an underside of the upper surface portion 811 at fixed intervals, for deflecting a direction of the washing water pumped to the tub cover to a center direction of the inner tub. The main deflector 812 is formed to connect an inner and an outer diameters of the upper surface portion of the tub cover, with an angle θ1 to a radial direction of the tub cover. And, supplementary deflectors 814 may be further provided for smoother guide of the washing water. The supplementary deflector 814 has a fore end started from the inner diameter, extended along a concentric circle with the tub cover substantially, and an aft end ended at a position of the main deflector 812. In this instance, the fore end of the supplementary deflector is preferably spaced from the fore end of the main deflector 812 by a preset distance L2. Therefore, the tub cover 800 is divided by the main deflectors 812 by fixed intervals S, wherein a space between the intervals S has a main flow passage W1 formed by the main deflector 812 and the supplementary deflector 814 and a supplementary passage W2 formed by the supplementary deflector 814 and the vertical deflector 813.

The operation of this embodiment will be explained.

The washing water pumped to the tub cover 800 is guided by the tub cover 800 into the inner tub with a minimum friction. In detail, the washing water risen upwardly is brought in contact with a bottom surface of the tub cover 800. Then, the washing water is guided by the main deflectors 812 and the supplementary deflectors 814 to deflect a flow direction from a tangential direction to a center direction of the inner tub. And, the washing water having a direction changed by the main passage W1 formed by the main deflector 812 and the supplementary deflector 814 hits onto the vertical deflector 813 again, to deflect a flow direction from horizontal to vertical downwardly, to supply the washing water to the inner tub lower portion. Most of the pumped washing water is guided by the main flow passages to be sprayed into the inner tub 103, while a portion of the pumped washing water flows into the inner tub 103 directly from the supplementary flow passage W2. Because most of the pumped washing water is guided by the main flow passages and the outlet P of each main passage W1 has a small width L2 and a limited number, that built up a pressure of the washing water, the washing water is intensely sprayed from the outlets, to improve the washing efficiency. In comparison to this, in the related art, since the washing water is sprayed from an entire inner diameter of the tub cover, the washing efficiency is poor because the spraying pressure is dispersed. Though the washing water flowed in a horizontal direction and hit onto the vertical deflector 813 turns its flow direction downwardly into the inner tub, a portion of the washing water is scattered by the impact of the hit. However, this embodiment tub cover can minimize scattering of the washing water, generation of noise, and foam formation because the washing water hits the supplementary deflector 814 before the washing water hits the vertical deflector 813. And, the washing water still scattered is prevented from leaking beyond an outer wall of the outer tub 102 by the projection 811*a* on the tub cover 800. And, as shown in FIG. 37A, a damping member 815 may preferably be provided at the outlet P side of the main passage W1, so that the washing water hits the damping member 815 beforehand, for effective prevention of the scattering of the washing water occurred when the washing water hits the vertical deflectors 813. The damping member 815 is disposed substantially perpendicular to a flow direction of the washing water, i.e., connected from a fore end of the supplementary deflector 814 to a fore end of the main deflector 812, with a height lower than heights of the main deflector 812 and the supplementary deflector 814. As shown in FIG. 37B, instead of the damping member, a sloped portion 817 may be provided at an outlet P of the main flow passage.

The following eighth embodiment tub cover is a modification from the seventh embodiment tub cover to suit to a case of both direction, i.e., regular and reverse direction rotation of the inner tub 103. An overall structure of the eighth embodiment tub cover will be explained with reference to FIG. 8.

Alike the seventh embodiment tub cover, the eighth embodiment tub cover 800 of the present invention also includes the main deflectors, the supplementary deflectors, and the vertical deflectors, except that first main deflectors 812 and second main deflectors 812*a* are provided in correspondence to the both direction rotation, and a structure of the supplementary deflectors 814*a* is modified. In detail, the first main deflectors 812 are formed on an underside of the upper surface portion of the tub cover 800 at fixed intervals, and the second deflectors 812*a* are formed in symmetry to the first main deflectors 812. And, a fore end of the supplementary deflector 814*a* has a fore end started from the inner circumference and extended along a concentric circle of the tub cover, and an aft end connected to the inner circumference of the tub cover. That is, the fore end of the supplementary deflector 814*a* is positioned spaced from the fore end of the first main deflector 812, and the aft end of the supplementary deflector 814*a* is positioned spaced from the fore end of the second main deflector 812*a*. And, preferably there are a plurality of ribs 818 between the first main deflectors and the second main deflectors 812*a* for preventing distortion, and more preferably concentric to the tub cover circumference. And, a portion of an outer rib may be cut away. The ribs 818 are fitted under the following reasons. The washing water passed over the main deflectors 812 and 812*a* may cause a vortex between the first and the second main deflectors 812 and 812*a*, or may flow to the outlet of the main flow passage, to interfere the washing water flow in the main flow passage. Therefore, the ribs 818 are provided to confine the washing water between the first and second deflectors 812 and 812*a* to some extent, for preventing interference to the washing water in the main flow passage. Thus, the tub cover is divided by the first main deflectors 812 and the second main deflectors 812*a* into fixed intervals S. And, a space between the intervals S has a main flow passage W1 formed by the main deflector 812 and a just prior supplementary deflector 812*a*, and a supplementary passage W2 formed by the supplementary deflector 812*a* and the vertical deflector 813. And, there is a space formed by the first main deflector 812 and an adjacent second main deflector 812*a*. Accordingly, when the inner tub rotates in a regular direction(a counter clockwise direction on the drawing), most of the washing water pumped to the tub cover is guided by the tub cover as shown in arrows of solid lines to be sprayed into the inner tub through the regular direction outlets P3 with a minimum friction. Opposite to this, when the inner tub rotates in a reverse direction(a clockwise direction on the drawing), most of the washing water pumped to the tub cover is guided by the tub cover as shown in arrows of dotted lines to be sprayed into the inner tub through the reverse direction outlets P4 with a minimum friction. Therefore, the eighth embodiment tub cover can cope with all the regular and reverse direction rotation, effectively.

In the meantime, as shown in FIG. 39, a portion of the regular direction outlet P3 and the reverse direction outlet P4*a* may be cut away to form an opening 816, for minimizing the scattering of the washing water caused by the washing water hitting onto the vertical deflector 813. In the meantime, as shown in FIGS. 40 and 41, identical to the seventh embodiment, either the damping member 815 or the sloped portion 817 is provided for effective prevention of the washing water scattering. And, it is preferable that a sealing member is provided between the tub cover and the outer tub.

As has been explained, the penetration type washing machine, the method for controlling the same, and the tub cover for the same have the following advantages.

First, the penetration type washing machine can make washing using an appropriate combination of the penetration washing, the agitating washing, and the restoration circulation washing. Therefore, a washing efficiency can be improved while damage to, and entangling of the laundry is minimized. And, the washing can be carried out only with a small amount of washing water, consumption of water and detergent may be reduced, with consequential reduction of drain time period, to reduce an overall washing time.

Second, the tub cover of the present invention can improve a pumping efficiency of the washing water because leakage or scattering of the pumped washing water can be prevented and the washing water can be guided into the inner tub without friction loss. And, the noise and foam caused by the circulated washing water at the high speed rotation of the inner tub can be minimized.

Third, as the tub cover of the present invention facilitates spray of the pumped washing water toward a center of the inner rub, a washing efficiency can be improved.

It will be apparent to those skilled in the art that various modifications and variations can be made in the penetration type washing machine, the method for controlling the same, and the tub cover for the same of the present invention without departing from the spirit or scope of the invention. Thus, it is intended that the present invention cover the modifications and variations of this invention provided they come within the scope of the appended claims and their equivalents.

The foregoing embodiments and advantages are merely exemplary and are not to be construed as limiting the present invention. The present teaching can be readily applied to other types of apparatuses. The description of the present invention is intended to be illustrative, and not to limit the scope of the claims. Many alternatives, modifications, and variations will be apparent to those skilled in the art. In the claims, means-plus-function clauses are intended to cover the structures described herein as performing the recited function and not only structural equivalents but also equivalent structures.

What is claimed is:

1. A washing machine, comprising:

an outer tub configured to store washing water;

an inner tub rotatably mounted in the outer tub and having a plurality of holes;

a pulsator configured to form a water circulation for washing laundry; and a motor installed under the outer tub and configured to rotate the inner tub and the pulsator, wherein the motor is configured to vary a rotation speed of the inner tub and the pulsator, such that the laundry is washed by a combination of modes as follows:

a centrifugal force washing mode, wherein the motor rotates the inner tub and the pulsator in the same direction for a first predetermined period of time, thereby creating a centrifugal force that is varied according to a variation of the rotation speed, which pushes the laundry against a wall of the inner tub and forces the washing water in the inner tub to penetrate through the laundry, to pass through the holes to the outer tub, and to flow upwardly through a space provided between the inner tub and the outer tub so as to recirculate into the inner tub; and an agitation washing mode, wherein the motor rotates the inner tub and the pulsator in the same direction at an identical speed, and then rotates the inner tub and the pulsator in a first direction for a second predetermined period of time and then in a second, reverse direction for the second predetermined period of time.

2. The washing machine according to claim 1, wherein the centrifugal force washing mode further comprises a restoration washing mode wherein the motor rotates the inner tub in a first direction at a high speed, and then rotates the inner tub in a second direction or stops rotating the motor to separate the laundry from a wall of the inner tub.

3. The washing machine according to claim 1, wherein the centrifugal force washing mode further comprises a restoration washing mode wherein the motor rotates the inner tub at a high speed in the first direction and then in a second direction, alternately.

4. The washing machine according to claim 1, wherein the motor includes a stator and a rotor surrounding an outer circumference of the stator.

5. The washing machine according to claim 1, wherein the second predetermined period of time being shorter than the first predetermined period of time.

6. The washing machine according to claim 1, wherein the motor rotates the inner tub at a speed lower than the first speed in the agitation washing mode.

* * * * *